US012623835B2

(12) United States Patent
Wang et al.

(10) Patent No.: US 12,623,835 B2
(45) Date of Patent: May 12, 2026

(54) CONTAINER WALLBOARD MODULE AND CONTAINER

(71) Applicant: QINGDAO CIMC REEFER TRAILER CO., LTD, Qingdao (CN)

(72) Inventors: Xiaoyi Wang, Qingdao (CN); Niancheng Zhou, Jiaozhou City (CN); Yan Xu, Qingdao (CN)

(73) Assignee: QINGDAO CIMC REEFER TRAILER CO., LTD, Qingdao (CN)

( * ) Notice: Subject to any disclaimer, the term of this patent is extended or adjusted under 35 U.S.C. 154(b) by 293 days.

(21) Appl. No.: 18/194,411

(22) Filed: Mar. 31, 2023

(65) Prior Publication Data

US 2024/0174436 A1 May 30, 2024

(30) Foreign Application Priority Data

Nov. 24, 2022 (CN) ..... 202211485151.1

(51) Int. Cl.
*B65D 88/52* (2006.01)
*B65D 88/10* (2006.01)
(Continued)

(52) U.S. Cl.
CPC ..... *B65D 88/528* (2013.01); *B65D 88/10* (2013.01); *B65D 90/023* (2013.01); *B65D 90/08* (2013.01);
(Continued)

(58) Field of Classification Search
CPC .... B65D 88/526; B65D 88/528; B65D 88/10; B65D 88/12; B65D 88/121; B65D 90/02;
(Continued)

(56) References Cited

U.S. PATENT DOCUMENTS 5,449,081 A * 9/1995 Sjostedt ..... B62D 29/045 220/666
2015/0336732 A1 11/2015 Denson
(Continued)

FOREIGN PATENT DOCUMENTS

| | | | |
|---|---|---|---|
| CN | 2895312 | Y | 5/2007 |
| CN | 208007742 | U | 10/2018 |
| CN | 111874470 | A | 11/2020 |

OTHER PUBLICATIONS

China National Intellectual Property Administration, Office Action re: Application 202211485151.1, Jan. 12, 2026, 16 pages.

*Primary Examiner* — Don M Anderson
(74) *Attorney, Agent, or Firm* — Mei & Mark LLP

(57) ABSTRACT

This disclosure provides a container wallboard module and a container. The container wallboard module includes a wallboard body and two side columns. The side columns deviate from two ends of the wallboard body in a length direction. The wallboard body is provided with assembly holes for detachable connection with other wallboard modules. The side column includes a column riser body and two connecting ends respectively formed at upper and lower ends of the column riser body. The connecting ends protrude from the column riser body in a front-back direction, and the connecting end is provided with a connecting hole for detachable connection with other wallboard modules. The container includes two side wall modules, a roof panel module, a bottom plate module, a front wall module and a rear wall module, all of which are detachably connected. The side columns, a top gusset and a bottom gusset form a column frame.

15 Claims, 17 Drawing Sheets

(51) Int. Cl.
*B65D 90/02* (2019.01)
*B65D 90/08* (2006.01)

(52) U.S. Cl.
CPC ..... *B65D 2588/02* (2013.01); *B65D 2590/02* (2013.01)

(58) Field of Classification Search
CPC .. B65D 90/023; B65D 90/08; B65D 2588/02; B65D 2588/12; B65D 2590/02
See application file for complete search history.

(56) References Cited

U.S. PATENT DOCUMENTS

| | | | | |
|---|---|---|---|---|
| 2016/0137404 | A1* | 5/2016 | Steiner | B61D 9/14 220/1.5 |
| 2016/0137406 | A1* | 5/2016 | Baik | B65D 90/0006 220/682 |
| 2019/0202600 | A1* | 7/2019 | Burke | B65D 21/083 |
| 2022/0048703 | A1* | 2/2022 | Zhou | B65D 90/02 |
| 2022/0048704 | A1* | 2/2022 | Grabmeier | B65D 88/123 |

* cited by examiner

CONTAINER WALLBOARD MODULE AND CONTAINER

CROSS-REFERENCE TO RELATED PATENT APPLICATIONS

The present application claims priority to Chinese Patent Application No. 202211485151.1, filed on Nov. 24, 2022, which is hereby incorporated by reference in its entirety.

TECHNICAL FIELD

The present disclosure relates to the technical field of containers, more particularly, to a container wallboard module and a container.

BACKGROUND

With the rapid development of overseas multimodal transport, the demand for containers will continue to grow. Currently, containers are assembled in manufacturing plants and shipped in assembled containers to overseas sales regions, and this mode of transportation has higher transportation costs, resulting in an increase in the use cost of containers. Therefore, there is a practical demand: the production and assembly of the components of the containers are separated, that is, the components of the container are usually manufactured in one place, then packaged in parts and shipped to a final assembly place, and then simply assembled to get a container.

SUMMARY

The technical problem to be solved by the present disclosure is to overcome the shortcomings of the prior art, and to provide a container wallboard module and a container, which can meet the practical demand of remote assembly.

To solve the above technical problems, the present disclosure provides a container wallboard module, which includes:

a wallboard body provided with assembly holes around for detachable connection with other wallboard modules; and two side columns disposed on the wallboard body, the side columns deviating from two ends of the wallboard body in a length direction, wherein a distance between the two side columns is 40 feet, wherein the side column comprises a column body and two connecting ends respectively formed at upper and lower ends of the column body, wherein the connecting ends protrude from the column body in a front-back direction, and are provided with connecting holes for detachable connection with the other wallboard modules.

In one embodiment, the side column includes a riser comprising a riser body and extensions respectively formed at two ends of the riser body, wherein the extensions is formed by extending in the front-back direction from the riser body; and a stiffener column located at one side of the riser and formed in an I-shape, wherein the stiffener column is designed to be wider at the two extensions, and the connecting hole is disposed on the extensions.

In one embodiment, the stiffener column comprises a column main body, and two patches are disposed at any end of the column body, and the column main body is connected at a position between the two patches.

In one embodiment, the wallboard body includes three segments of a corrugated plate disposed sequentially in a length direction, the side column is disposed between adjacent two segments of the corrugated plate, the corrugated plate includes a crest portion protruding outward and a trough portion concave inward, the side column is disposed at the crest portion, the riser is overlapped with the crest portion, and the stiffener column protrudes inward from the riser.

In one embodiment, a top of the wallboard body is provided with a top side rail from front to rear, and a notch is provided at a top of the side column, and the top side rail is disconnected at a position corresponding to the notch.

In one embodiment, the top side rail has an S-shaped cross-section and comprises a horizontal first connecting plate, a second connecting plate formed by extending vertically downward from an inner side of the first connecting plate, a third connecting plate formed by extending horizontally outward from the second connecting plate, a fourth connecting plate formed by extending vertically downward from the third connecting plate, and a fifth connecting plate formed by extending horizontally inward from the fourth connecting plate, wherein the first connecting plate is provided with an assembly hole for overlapping with other wallboard modules, and the third connecting plate is overlapped above a top end of the side column.

In one embodiment, a bottom of the wallboard body is provided with a bottom side rail from front to back, a notch is provided at a bottom of the side column, the bottom side rail is provided with a gap at a position corresponding to the notch, the gap is communicated with the notch, and an opening of the gap faces the bottom.

In one embodiment, the bottom side rail includes a horizontal first connecting wall, a second connecting wall formed by extending vertically downward from an inner side of the first connecting wall, a third connecting wall formed by extending horizontally outward from the second connecting wall, a fourth connecting wall formed by extending vertically downward from the third connecting wall, a fifth connecting wall formed by extending horizontally inward from the fourth connecting wall, a sixth connecting wall formed by extending vertically downward from the fifth connecting wall, and a seventh connecting wall formed by extending horizontally outward from the sixth connecting wall, wherein the gap is formed by disconnecting the fourth connecting wall, the fifth connecting wall, the sixth connecting wall and the seventh connecting wall.

In one embodiment, the wallboard body is provided with assembly columns at front and rear ends, each of the assembly columns is in a square tubular shape, and an assembly hole is opened in an inner side wall of the assembly column for detachable connection with the other wallboard modules.

The present disclosure further provides a container wallboard module including a first blind wave plate, a second blind wave plate and a third blind wave plate disposed sequentially in a length direction, and two top gussets, wherein one of the top gussets is detachably connected at a position between the first blind wave plate and the second blind wave plate, another one of the top gussets is detachably connected at a position between the second blind wave plate and the third blind wave plate, the top gusset includes a horizontal roof panel and connecting plates extending downward and disposed at two ends of the roof panel, the connecting plate is provided with a mounting hole for detachable connection with other wallboard modules, and a top corner is provided at a junction of the roof panel and each the connecting plate, the top corner is provided with a functional hole, and a distance between the functional holes of the two top gussets is 40 feet.

In one embodiment, the top corner includes a corner body, a top wall disposed on a top of the corner body and a side wall disposed on an outer side of the corner body, wherein the top wall protrudes from the corner body in a front-back direction, the side wall protrudes from the corner body in the front-back direction, and the top wall and the side wall are respectively provided with the functional holes.

In one embodiment, the top wall protrudes inward from the corner body in a horizontal direction; and the side wall protrudes downward from the corner body in an up-down direction.

In one embodiment, the top wall and the side wall are integrally connected to form an angle steel; and the corner body includes a bottom wall extending horizontally and three enclosing walls disposed on the bottom wall;

wherein the top wall is covered on the corner body, and the corner body, the top wall and the side wall together form a cavity, and the cavity is communicated with the functional hole.

In one embodiment, front and rear ends of the corner body are further provided with stiffeners disposed at positions among the top wall, the side wall and the corner body.

In one embodiment, front and rear ends of the roof panel are provided with assembly rails, the assembly rails are in a shape of a square tube, and a perforation is provided in a bottom wall of each the assembly rail;

the first blind wave plate, the second blind wave plate and the third blind wave plate are provided with bolt holes on sides facing the assembly rail; and the assembly rail is respectively overlapped above the first blind wave plate, the second blind wave plate and the third blind wave plate, and the top gusset is detachably connected to the first blind wave plate, the second blind wave plate and the third blind wave plate by fasteners.

In one embodiment, each of the first blind wave plate, the second blind wave plate and the third blind wave plate includes a crest portion protruding upward and a trough portion concave downward, the top gusset is disposed at the trough portion, the assembly rail is overlapped with the trough portion, and the roof panel protrudes upward from the trough portion.

The present invention further provides a container wallboard module including a first base module and a second base module being detachably connected to the first base module, wherein the first base module and the second base module are disposed sequentially in a longitudinal direction, and each of the first base module and the second base module is provided with a bottom gusset, wherein the bottom gusset comprises: a horizontal bottom plate and assembly plates extending upwardly and disposed at two ends of the bottom plate, and the assembly plate is provided with a through hole for detachable connection with other wallboard modules, wherein a bottom corner is disposed at a junction of the bottom plate and the assembly plate, and the bottom corner is provided with a function hole, and wherein a distance between the function holes of the two bottom gussets is 40 feet.

In one embodiment, the second base module includes: a base body and a rear-end gusset including a frame-type stiffener frame and a floor disposed on the stiffener frame. The stiffener frame and the floor made of steel, the base body has a rear end being detachably connected to a front end of the rear-end gusset.

In one embodiment, the rear-end gusset has a step at a front end, the base body is overlapped with the step, and an upper surface of the base body is flush with an upper surface of the floor.

In one embodiment, the first base module has a step at a rear end, and a bottom plate of the second base module protrudes forward and is overlapped with the step so that an upper surface of the first base module is flush with an upper surface of the second base module.

The present disclosure further provides a container, which includes two side wall modules, a roof panel module, a bottom plate module, a front wall module and a rear wall module, and the six parts are detachably connected;

the side wall module is the container wallboard module as described above, the roof panel module is the container wallboard module as described above, the bottom plate module is the container wallboard module as described above; and two ends of each of the side columns are respectively connected to the top gusset and the bottom gusset, two ends of the top gusset are respectively connected to side columns of the two side wall modules, two bottom corners of the bottom gusset are respectively connected to side columns of the two side wall modules, and corresponding side columns of the two side wall modules, the top gusset and the bottom gusset are enclosed together to form a column frame.

In one embodiment, the first blind wave plate, the second blind wave plate and the third blind wave plate are covered on top of the two side wall modules and are detachably connected by fasteners; and the connecting plate of the top gusset is located inside a connecting end of the side column, and the connecting plate of the top gusset and the connecting end of the side column are detachably connected by a fastener penetrating through a connecting hole and a mounting hole.

In one embodiment, a connecting plate of the bottom gusset is located inside a connecting end of the side column, and the connecting plate of the bottom gusset and the connecting end of the side column are detachably connected by a fastener penetrating through a connecting hole and a mounting hole.

In one embodiment, the front wall module and the rear wall module each include an end frame and a mounting plate on either side of the end frame, the mounting plate protrudes to the side wall module, a front end of each of the two side wall modules is one-to-one corresponding to the mounting plate of the front wall module, a wallboard body of each of the side wall modules is attached and detachably connected to an outer side of the corresponding mounting plate, the rear end of each of the two side wall modules is one-to-one corresponding to the mounting plate of the rear wall module, and the wallboard body of each of the side wall modules is attached and detachably connected to the outer side of the corresponding mounting plate.

In one embodiment, the wallboard body is provided with an assembly column at an outer side of the mounting plate, the assembly columns are in a square tubular shape, an assembly hole is opened in an inner side wall of the assembly column, and the assembly hole is detachably connected to a bolt hole on the mounting plate by a fastener.

In one embodiment, the front wall module and the rear wall module each comprise an end frame and a mounting rail located at a top of the end frame, wherein the mounting rail protrudes to the roof panel module, the mounting rail is in a shape of a square tube, a perforation is opened on a bottom wall of the mounting rail, and the first blind wave plate and the third blind wave plate are provided with bolt holes on sides facing the mounting rail; and the mounting rail of the front wall module is overlapped above the first blind wave plate, and the front wall module is detachably connected to the roof panel module by a fastener, the mounting rail of the rear wall module is overlapped above the third blind wave plate, and the rear wall module is detachably connected to the roof panel module by the fastener.

In one embodiment, the front wall module includes an end frame, of which a bottom end sill is opened with a bolt hole, wherein an end portion of the front end of the first base module is provided with a through hole, and the bottom end sill is attached to the front end of the first base module and is detachably connected to the front end of the first base module by a fastener.

In one embodiment, wherein the rear wall module comprises an end frame and a connecting rail disposed at a bottom of the end frame, wherein the connecting rail protrudes to the bottom plate module and provided with an accommodating cavity with an opening facing the bottom plate module, wherein a rear end of the second base module of the bottom plate module is inserted into the accommodating cavity and is detachably connected to the accommodating cavity by a fastener.

In one embodiment, the connecting plate of the top gusset comprises a protrusion protruding downward and outward from the top corner, wherein the protrusion is provided with the mounting hole, and the connecting end of the side column is provided with a containing groove with an inward opening at an inner side, the containing groove is provided with the connecting hole at an outer side wall, the protrusion is located in the containing groove, and a fastener penetrates into the connecting hole and the mounting hole simultaneously.

In one embodiment, an assembly plate of the bottom gusset comprises a projection protruding upward and outward from the bottom corner, wherein the projection protruding is provided with the assembly hole, and the connecting end of the side column is provided with a containing groove with an inward opening at an inner side, the containing groove is provided with the connecting hole at an outer side wall, the projection is located in the containing groove, and a fastener penetrates into the connecting hole and the assembly hole simultaneously.

In one embodiment, the container further includes bottom corners at four corners of a bottom;

wherein two bottom corners at a front end are fixed on a front end of the bottom plate module, and two bottom corners at a rear end are fixed on a bottom of the rear wall module.

In one embodiment, the front wall module includes two corner posts disposed in parallel at intervals; and an inclined connecting surface is disposed between a front end surface and an outer side surface of each of the corner posts, an included angle between the inclined connecting surface and the front end surface is an obtuse angle, and an included angle between the inclined connecting surface and the outer side surface is an obtuse angle.

In one embodiment, the front wall module includes two corner posts disposed in parallel at intervals; and a circular arc connecting surface is disposed between a front end surface and an outer side surface of each of the corner posts, and the circular arc connecting surface has a convex surface facing outward.

From the technical solution, it can be seen that the advantages and positive effects of the present disclosure are as follows:

One of the container wallboard modules in the present disclosure, i.e., the side wall module, includes two side columns with a distance of 40 feet therebetween, and the upper and lower ends of each column are widened to increase the strength of the side columns.

Another container wallboard module of the present disclosure, i.e., the roof panel module, includes two top gussets with a distance of 40 feet therebetween, each of the top gussets includes two top corners, and the strength of each of the top corners is increased by widening the top and side walls.

According to the present disclosure, due to the six container box modules being detachably connected, the container can be manufactured, packaged and transported in pieces, and can be assembled and delivered in different places, so that the cost is reduced.

The side columns of the corresponding two side wall modules, the top gussets of the roof panel module and the bottom gussets of the bottom plate module are enclosed to form a column frame, which the strength of the side column is increased by widening the upper and lower ends of each side column respectively, thereby increasing the strength of the column frame and effectively improving the impact resistance performance.

The reference signs are described as follows: 800. container; 1. side wall module; 11. side column; 111. column body; 112. connecting end; 1151. riser body; 1152. extension; 1153. flanging; 1154. notch; 1161. column main body; 1162. patch; 12. corrugated plate; 121. crest portion; 122. trough portion; 13. top side rail; 14. bottom side rail; 15. assembly column;

- 2. roof panel module; 21. first blind wave plate; 211. crest portion; 212. trough portion; 22. second blind wave plate; 23. third blind wave plate; 24. top gusset; 241. roof panel; 242. connecting plate; 243. top corner; 2431. top wall; 2432. side wall; 2433. corner body; 244. stiffener; 245. assembly rail;
- 3. bottom plate module; 31. first base module; 32. second base module; 321. base body; 322. rear-end gusset; 36. bottom gusset;
- 4. front wall module; 41. end frame; 411. corner post; 412. bottom end sill; 42. mounting plate; 43. mounting rail;
- 5. rear wall module; 51. mounting plate; 52. mounting rail; 53. bottom-end transverse member; 54. corner plate.

DESCRIPTION OF THE EMBODIMENTS

Exemplary embodiments embodying the features and advantages of the present disclosure will be described in detail in the following description. It is to be understood that the present disclosure is capable of other variations in different embodiments without departing from the scope of the present disclosure and that the description and illustrations therein are intended to be illustrative in nature and not to limit the present disclosure.

To further illustrate the principle and structure of the present disclosure, preferred embodiments of the present disclosure are described in detail with reference to the accompanying drawings.

The present disclosure provides a container with a large size, which can meet the requirements of piecewise manufacturing, packaging and transportation, as well as remote final assembly, and reduced cost.

The container may be a non-standard container, which can be a 53-foot container or a 45-foot container.

Figure 1:
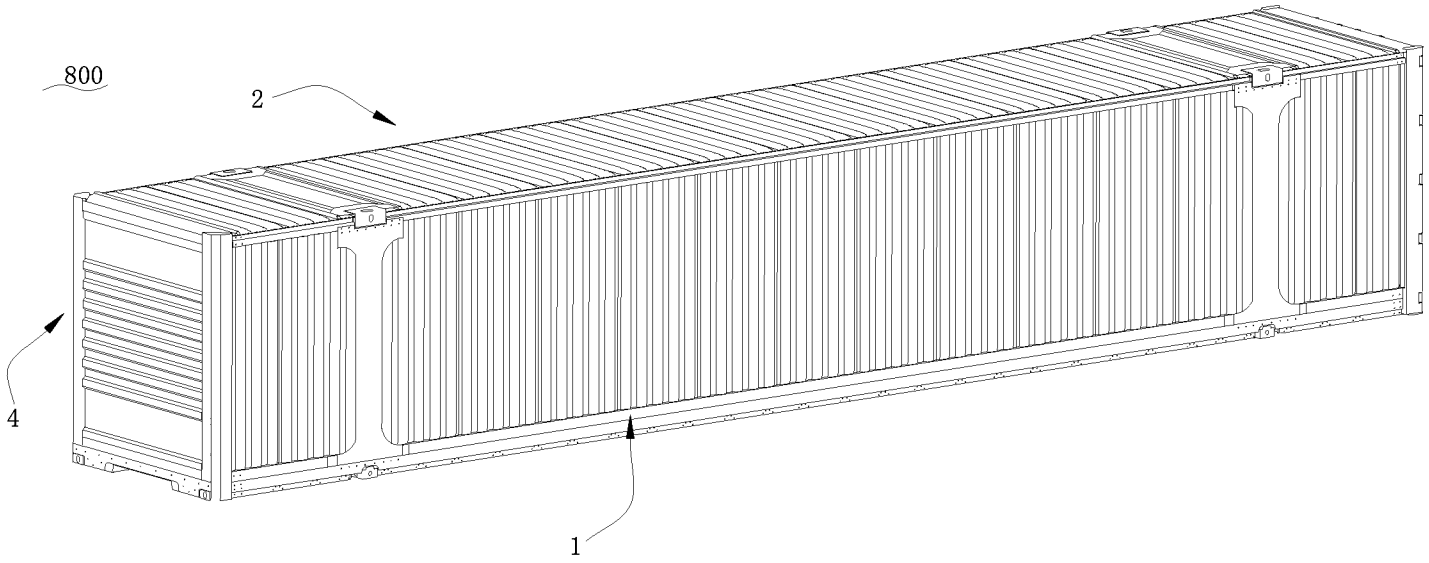
FIG. 1 is a structural schematic diagram of a container in an embodiment of the present disclosure.
Figure 2:
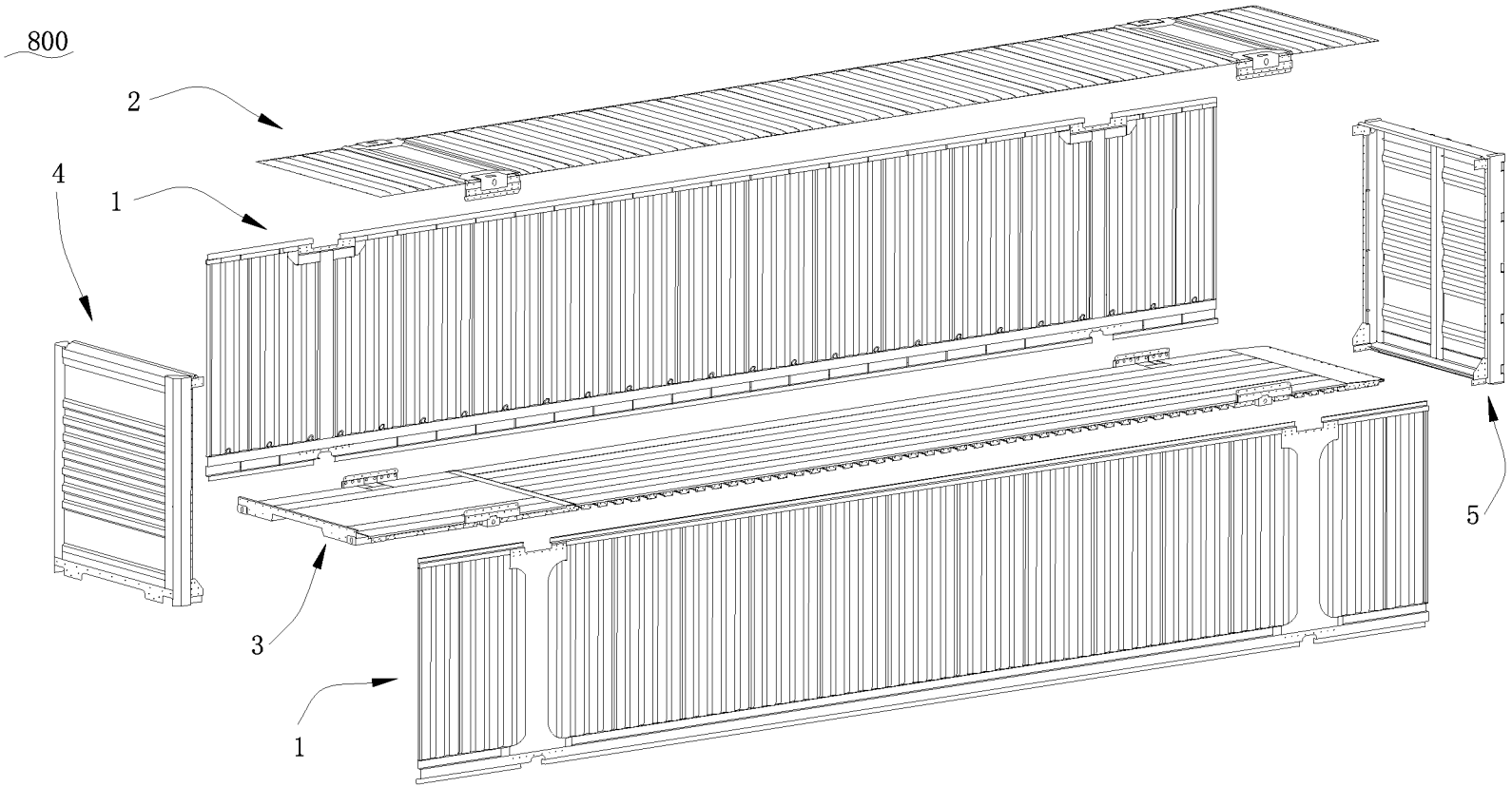
FIG. 2 is an exploded schematic diagram of the container in an embodiment of the present disclosure.

FIG. 1 show a structural schematic diagram of a container in this embodiment, FIG. 2 shows an exploded schematic diagram of the container in this embodiment. Referring to FIGS. 1 and 2, a container 800 includes six container wallboard modules. They are respectively two side wall modules 1, a roof panel module 2, a bottom plate module 3, a front wall module 4 and a rear wall module 5. The six container wallboard modules are detachably connected, so that each container wallboard module can be independently manufactured and surface treated, which reduces the requirements for tooling and equipment, and enables each container wallboard module to be packaged separately and transported to different places for final assembly. The connection between the six container wallboard modules is simple, which is convenient for installation and maintenance.

The six container wallboard modules of the container 800, namely, two side wall modules 1, the roof panel module 2, the bottom plate module 3, the front wall module 4, and the rear wall module 5, are described respectively below.

Figure 3:
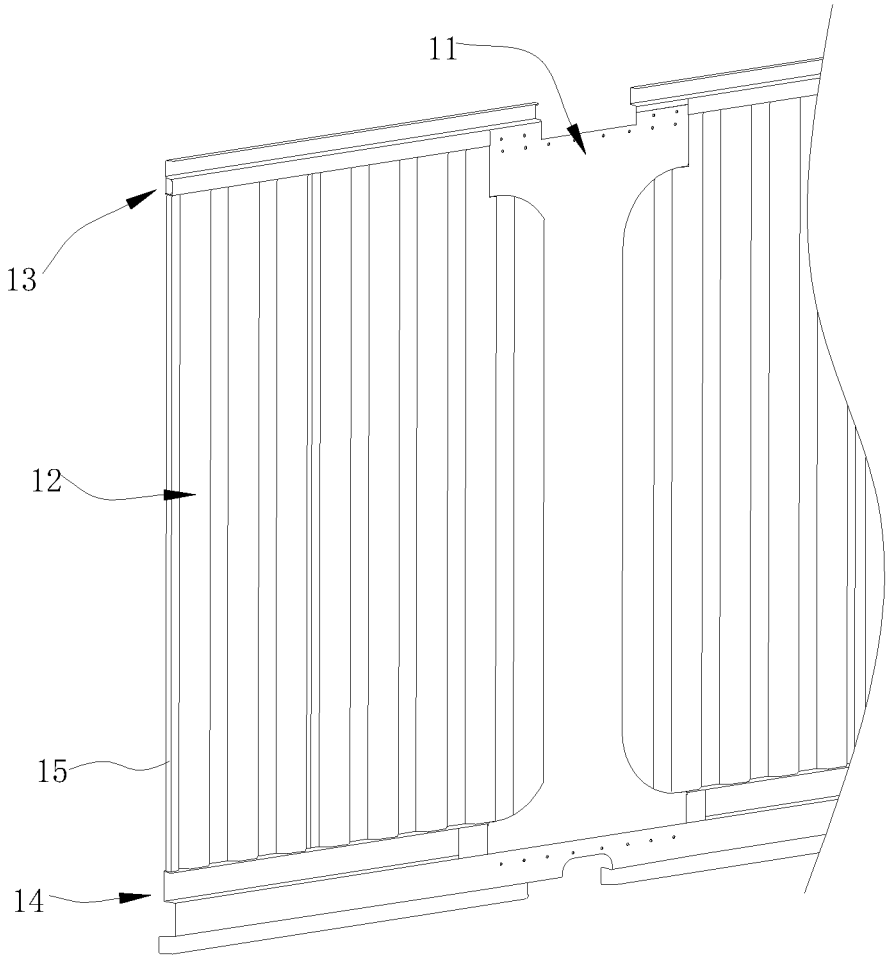
FIG. 3 is a partial structural schematic diagram of a side wall module in an embodiment of the present disclosure.

FIG. 3 shows a partial structural schematic diagram of the side wall module 1, with reference to FIGS. 2 and 3, the side wall module 1 includes a wallboard body and two side columns 11 provided on the wallboard body. The side columns 11 deviate from both ends of the wallboard body in a length direction, that is, the side columns 11 are not provided at the ends of the wallboard body. A distance between the two side columns 11 may be 40 feet. The side wall module 1 may be made to meet the requirements of a standard container by means of side columns 11 at a distance of 40 feet.

Figure 4:
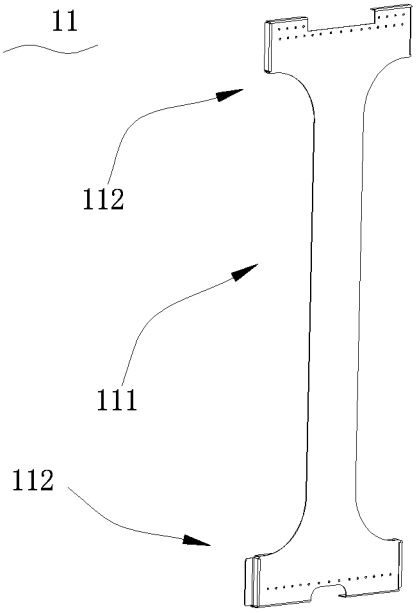
FIG. 4 is a structural schematic diagram of a side column in an embodiment of the present disclosure.
Figure 5:
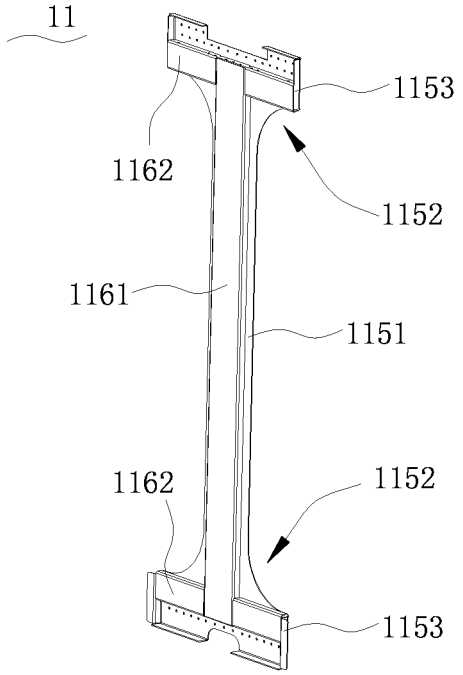
FIG. 5 is a structural schematic diagram of the side column in another direction in the present disclosure.

FIG. 4 and FIG. 5 respectively show structural schematic diagrams of the side column 11 at different angles. With reference to FIG. 4 and FIG. 5, the side column 11 includes a column body 111 and two connecting ends 112 respectively formed at the upper and lower ends of the column body 111. The connecting ends 112 protrude from the column body 111 in the front-back direction, and the connecting ends 112 are provided with connecting holes for detachable connection with other wallboard modules. Both ends of the side column 11 are increased in size by the connecting ends 112 that protrude in the front-back direction, thereby increasing the strength of the side column 11.

In the present application, the side column 11 is divided into the column body 111 and the two connecting ends 112 mainly according to their shapes and positions. The front-back direction in the present application refers to the length direction of the side wall module 1.

Specifically, the side columns 11 include a riser and stiffener columns located on one side of the riser. Referring to the service state of the container 800, stiffener columns of the side columns 11 of the disclosure modules 1 are disposed opposite each other. That is, the stiffener column of the side column 11 is located inside the riser.

The riser includes a riser body 1151 and extensions 1152 respectively formed at both ends of the riser body 1151. The extensions 1152 are formed by extending the riser body 1151 in the front-back direction.

Further, the extensions 1152 and the riser body 1151 may both be symmetrical along the same vertical axis.

In this embodiment, the extension 1152 includes a diverging unit and a flattening unit. A dimension of the diverging unit is gradually expanded forward and backward in a direction away from the riser body 1151, and the dimension of the flattening unit is uniform in the front-back direction, and is identical to the dimension of the end of the diverging unit away from the riser body 1151. The connecting hole is provided on the extension 1152. The extension 1152 is provided with a notch 1154. The openings of the notches 1154 of the two extensions 1152 are separated from each other, i.e., the opening of the extension 1152 at the upper end faces upward and the opening of the extension 1152 at the lower end faces downward.

In this embodiment, the connecting hole is disposed on the flattening unit. The notch 1154 is provided on the flattening unit.

Further, the extension 1152 is provided with a flanging 1153 protruding inward. Inside and outside are referenced by the service state of the container 800, and those facing the area enclosed by the two side wall modules 1 are inside, and vice versa.

The flanging 1153 on the upper extension 1152 includes an upper flanging and first side flangings. The upper flanging is provided at the top end of the extension 1152. Two first side flangings are disposed on both sides of the extension 1152 along the length direction of the side wall module 1. The extension 1152, the upper flanging, and the first side flanging are enclosed together to form a containing groove with an inward opening.

The flanging 1153 on the lower extension 1152 includes a lower flanging and second side flangings. The lower flanging is provided at the bottom end of the extension 1152. Two second side flangings are disposed on both sides of the extension 1152 along the length direction of the side wall module 1. In this embodiment, the second side flanging includes a transition part perpendicular to the extension 1152 and formed by integrally extending the extension 1152, and a lap part parallel to the extension 1152 and located inside the extension 1152, and the lap part is formed by integrally extending the transition part.

The stiffener column is I-shaped. The stiffener column includes a column main body 1161, two patches 1162 are provided at any end of the column main body 1161, and the column main body 1161 is connected at a position between the two patches 1162. That is, the top end of the column main body 1161 is provided with two patches 1162, and the bottom end of the column main body 1161 is also provided with two patches 1162. In this embodiment, the stiffener column is integrally formed. In other embodiments, the stiffening column may also be obtained by welding the column main body 1161 to the patches 1162.

The column 1161 has a square cross section. In this embodiment, the column main body 1161 is made of square tubular shaped steel.

Both wider ends of the stiffening column are respectively located at two extensions 1152. That is, the patches 1162 are all located at the extensions 1152.

Assembly holes for detachable connection with other wallboard modules are disposed around the wallboard body. In this embodiment, the top of the wallboard body is provided with a top side rail 13 from front to rear, and the bottom of the wallboard body is provided with a bottom side rail 14 from front to rear, and a corrugated plate 12 is disposed between the top side rail 13 and the bottom side rail 14. The top side rail 13 and the bottom side rail 14 each extend in the length direction of the side wall module 1.

The plate 12 may be grouped in threes, that is, the wallboard body includes three segments of corrugated plate 12 disposed sequentially in the length direction. In this case, the side columns 11 are disposed between two adjacent segments of the corrugated plate 12.

Figure 6:
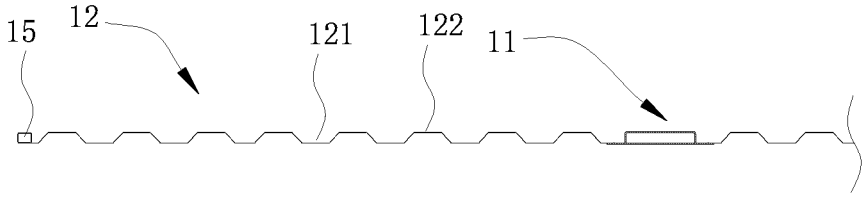
FIG. 6 is a side view of the side column connected to a corrugated plate in the present disclosure.

FIG. 6 shows a side view of the side column 11 connected to the corrugated plate 12. Referring to FIG. 6, the corrugated plate 12 includes a crest portion 121 protruding outward and a trough portion 122 recessed inward. The side column 11 is provided at the crest portion 121, the riser is overlapped with the crest portion 121, and the stiffener column protrudes inward from the riser. In this embodiment, an inner side surface of the side column 11 is flush with an inner side surface of the corrugated plate 12.

The corrugated plate 12 is welded to the side column 11, and an outer profile of a side portion of the corrugated plate 12 close to the side column 11 is matched with the shape of the side column 11.

In other embodiments, the corrugated plate 12 may be integral, i.e., the wallboard body includes one corrugated plate 12. In this case, the side columns 11 may be disposed on the inner side of the whole corrugated plate 12. In this case, the corrugated plate 12 has a configuration such that the side column 11 is provided at the crest portion 121 extending long in the length direction, and the side column 11 is attached to the crest portion 121.

The top side rail 13 is disconnected at a position corresponding to the notch 1154 of the side column 11, i.e., the top side rail 13 includes three rail sections disposed sequentially in the length direction. One side column 11 is disposed between two adjacent rail sections. And the side portions of the side columns 11 in the front-back direction are connected to the side portions of the top side rails 13.

Specifically, the top side rail 13 has an S-shaped cross-section and includes a horizontal first connecting plate, a second connecting plate formed by vertical downward extension of an inner side of the first connecting plate, a third connecting plate formed by horizontal outward extension of the second connecting plate, a fourth connecting plate formed by vertical downward extension of the third connecting plate, and a fifth connecting plate formed by horizontal inward extension of the fourth connecting plate. The first connecting plate is provided with assembly holes for overlapping with other wallboard modules. The third connecting plate is overlapped above a top end of the side column 11.

That is, the top side rail 13 includes two grooves with their openings facing away from each other, the upper recess has its opening facing outwards and the lower recess has its opening facing inwards.

When the side column 11 is connected to the top side rail 13, the upper flanging on the top of the side column 11 is overlapped with the third connecting plate, and the first flanging is vertically connected to the top side rail 13.

The bottom side rail 14 is provided with a gap at a position corresponding to the notch 1154 of the side column 11, the gap communicates with the notch 1154, and the opening of the gap faces the bottom.

Specifically, the bottom side rail 14 includes a horizontal first connecting wall, a second connecting wall formed by extending vertically downward from an inner side of the first connecting wall, a third connecting wall formed by extending horizontally outward from the second connecting wall, a fourth connecting wall formed by extending vertically downward from the third connecting wall, a fifth connecting wall formed by extending horizontally inward from the fourth connecting wall, a sixth connecting wall formed by extending vertically downward from the fifth connecting wall, and a seventh connecting wall formed by extending horizontally outward from the sixth connecting wall. A gap is formed by disconnecting the fourth connecting wall, the fifth connecting wall, the sixth connecting wall and the seventh connecting wall. The first connecting wall, the second connecting wall and the third connecting wall extend from front to back along the length of the side wall module 1.

That is, the bottom side rail 14 includes three grooves, and the openings of any two adjacent grooves face opposite directions. The middle groove has its opening facing inward, the upper and lower grooves have their openings facing outward, and the middle groove and the lower groove communicates with the gaps in the bottom side rail 14.

Front and rear ends of the wallboard body are provided with assembly columns 15. Each of the assembly column 15 is in the shape of a square tube, and assembly holes for detachable connection with other wallboard modules are provided on the inner wall thereof. The assembly column 15 is welded to the corrugated plate 12.

Specifically, the assembly column 15 is provided at the crest portion 121. In this embodiment, the assembly column 15 is welded to the crest portion 121.

The side wall module 1 in this embodiment is a single unit, which is fabricated and surface treated at the place of manufacture, and then assembled with other wallboard modules after transport to the destination. The side wall module 1 increases the strength of the side column 11 by widening both ends of the side column 11.

Figure 7:
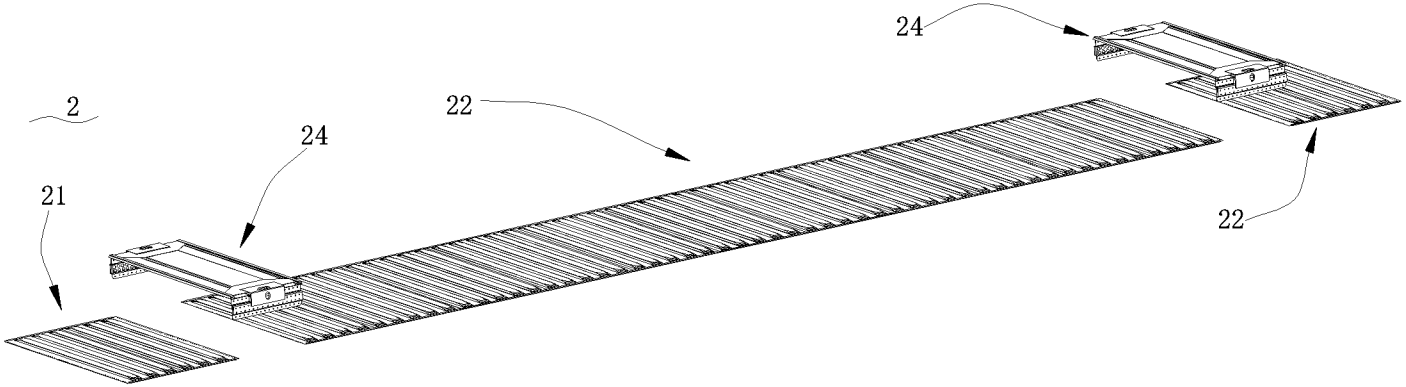
FIG. 7 is an exploded schematic diagram of a roof panel module in an embodiment of the present disclosure.
Figure 8:
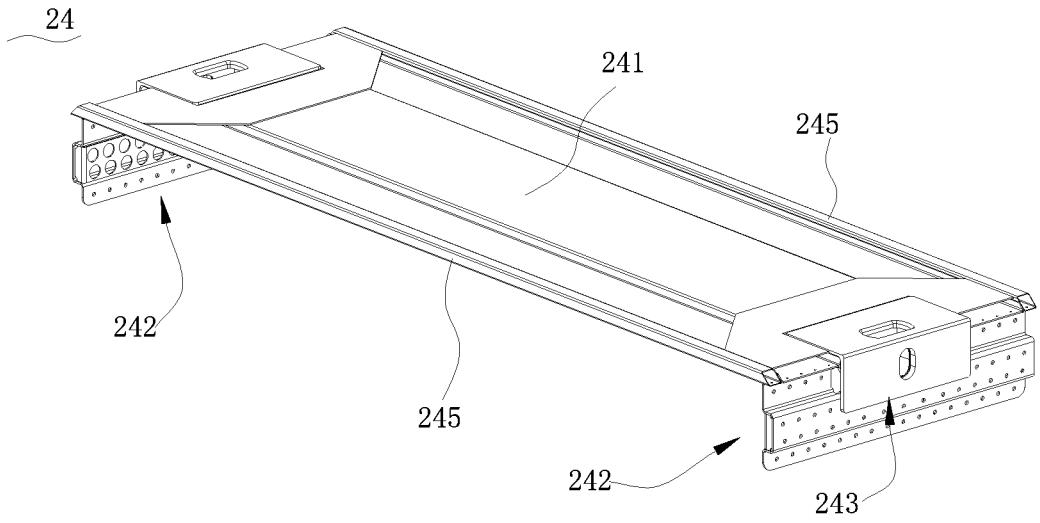
FIG. 8 is a structural schematic diagram of a top gusset in the present disclosure.
Figure 9:
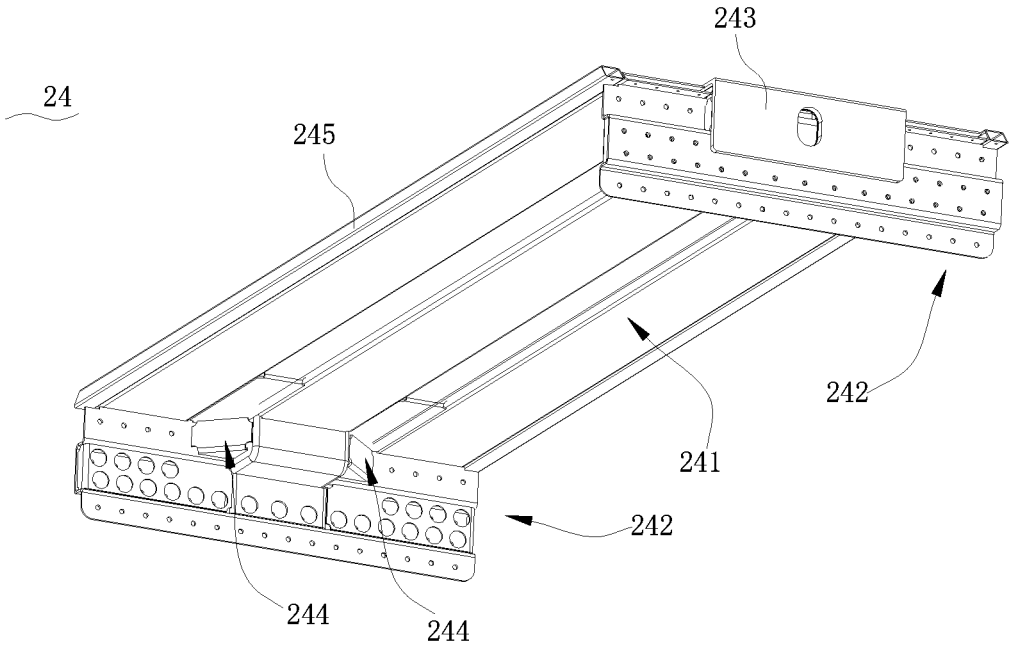
FIG. 9 is a structural schematic diagram of the top gusset in another direction in the present disclosure.
Figure 10:
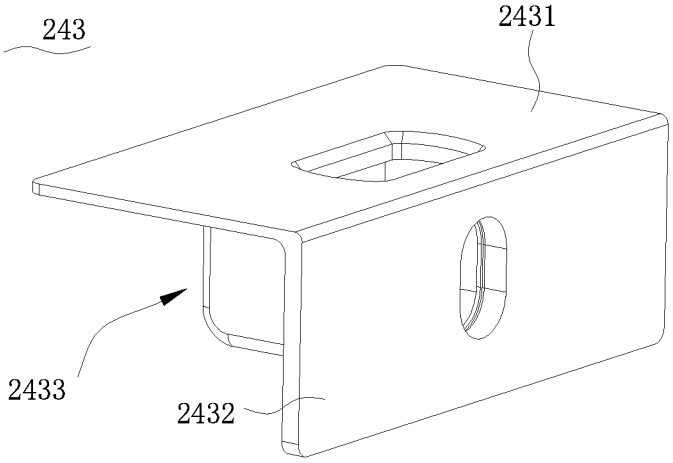
FIG. 10 is a structural schematic diagram of a top corner in the present disclosure.
Figure 11:
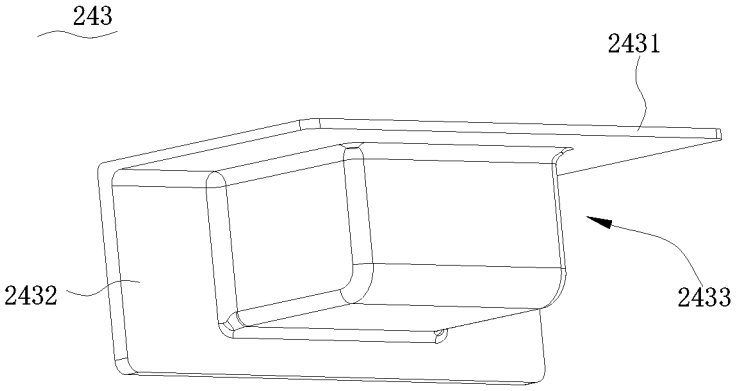
FIG. 11 is a structural schematic diagram of the top corner in another direction in the present disclosure.
Figure 12:
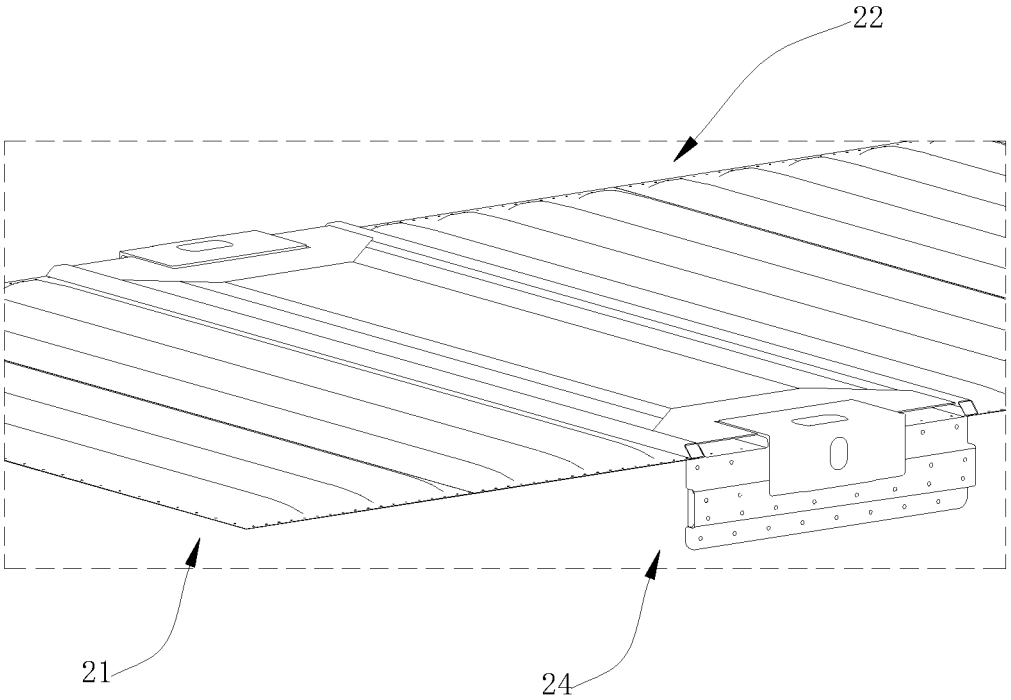
FIG. 12 is a partial structural schematic diagram of the roof panel module in an embodiment of the present disclosure.
Figure 13:
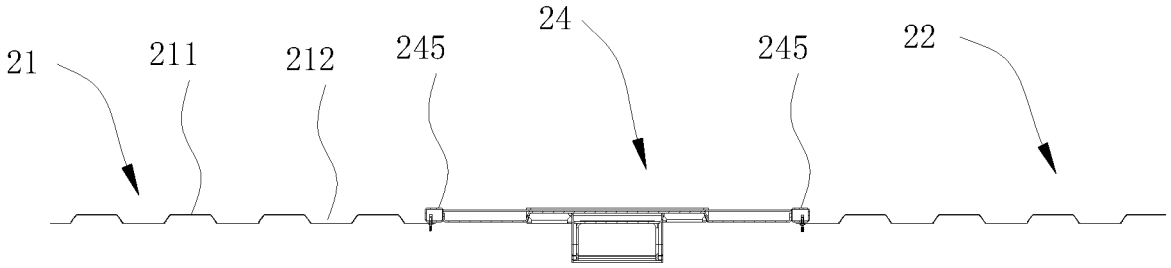
FIG. 13 is a side view of the top gusset with a first blind wave plate and a second blind wave plate in the present disclosure.

FIG. 7 shows an exploded schematic diagram of the roof panel module 2, with reference to FIG. 2, FIG. 7 and FIG. 8. The roof panel module 2 includes a first blind wave plate 21, a second blind wave plate 22, a third blind wave plate 23 disposed sequentially in the length direction and two top gussets 24. One of the top gussets 24 is detachably connected to and located between the first blind wave plate 21 and the second blind wave plate 22, and the other of the top gussets 24 is detachably connected to and located between the second blind wave plate 22 and the third blind wave plate 23. The top gusset 24 includes a horizontal roof panel 241 and connecting plates 242 provided at both ends of the roof panel 241 and extending downward. Each of the connecting plates 242 are provided with mounting holes for detachable connection with other wallboard modules. A top corner 243 is provided at a junction of the roof panel 241 and the connecting plate 242, and a function hole is provided in the top corner 243, and a distance between the function holes of the two top gussets 24 may be 40 feet. The roof panel module may be made to meet the requirements of a standard container 800 by means of the functional holes at a distance of 40 feet.

The roof panel 241 and the two connecting plates 242 form an inverted U-shaped structure. In this embodiment, the roof panel 241 and the connecting plate 242 are integrally formed. In other embodiments, the connecting plate 242 is welded to the roof panel 241.

The top corner 243 includes a corner body 2433, a top wall 2431 provided on the top of the corner body 2433 and a side wall 2432 provided outside the corner body 2433. The top wall 2431 protrudes from the corner body 2433 in the front-back direction, the side wall 2432 protrudes from the corner body 2433 in the front-back direction, and functional holes are respectively provided on the top wall 2431 and the side wall 2432. The strength of the top corner 243 is increased by increasing the size of the top wall 2431 and the bottom wall.

The function hole in the top wall 2431 plays the role of bolting and lifting, and the function hole in the side wall 2432 plays the role of bolting, lifting and observing.

Further, the top wall 2431 protrudes inward from the corner body 2433 in the horizontal direction. The side wall 2432 protrudes downward from the corner body 2433 in the up-down direction.

The top wall 2431 and the side wall 2432 may be integrally formed as an angled portion of steel.

The corner body 2433 includes a horizontally extending bottom wall and three enclosing walls provided on the bottom wall, with no enclosing walls provided on the outward facing sides of the bottom wall, i.e., the front and rear ends and an inner side of the bottom wall are provided with enclosing walls.

The top wall 2431 covers the corner body 2433, and the corner body 2433, the top wall 2431 and the side wall 2432 together form a cavity, and the cavity communicates with the functional hole.

Each of the front and rear ends of the corner body 2433 is also provided with a stiffener 244. The stiffener 244 is provided at a position among the top wall 2431, the side wall 2432, and the corner body 2433.

In this embodiment, the cross section of the stiffener 244 is triangular.

The front and rear ends of the roof panel 241 are provided with assembly rails 245, each of which extends in the left-right direction. The assembly rails 245 have a square tubular shape, and the bottom wall thereof is provided with a perforation. The front-back direction refers to the length direction of the roof panel module 2, that is, the direction facing the front wall module 4 is the front and the direction facing the rear wall module 5 is the rear. The left-right direction refers to the width direction of the roof panel module 2.

The first blind wave plate 21, the second blind wave plate 22, and the third blind wave plate 23 each include a crest portion 211 protruding upward and a trough portion 212 recessed downward. The terms of "upward" and "downward" are defined under the assembled state of the roof panel module 2.

The top gusset 24 is provided at the trough portion 212, the assembly rail 245 overlaps the trough portion 212, and the roof panel 241 protrudes upward from the trough portion 212. The top gusset 24 is accommodated at the trough portion 212 so that the top gusset 24 is prevented from protruding upwardly too much from the corrugated plate 12, so as to save space.

Bolt holes are provided on the side portions of the first blind wave plate 21, the second blind wave plate 22 and the third blind wave plate 23 facing the assembly rail 245, that is, the bolt holes are provided on the rear end of the first blind wave plate 21, the front and rear ends of the second blind wave plate 22 and the front end of the third blind wave plate 23. The assembly rail 245 is respectively overlapped above the first blind wave plate 21, the second blind wave plate 22 and the third blind wave plate 23, and the top gusset 24 is detachably connected to the first blind wave plate 21, the second blind wave plate 22 and the third blind wave plate 23 by fasteners.

When the top gusset 24 is connected to the first blind wave plate 21, the assembly rail 245 is overlapped over the first blind wave plate 21, and the fastener passes through the bolt hole in the first blind wave plate 21 and the perforation in the bottom wall from below. The fastener may be a rivet. Specifically, the fastener may be a blind rivet. At the same time, after the top gusset 24 and the first blind wave plate 21 are connected by fastener, a sealant may be applied between the assembly rail 245 and the first blind wave plate 21.

The top gusset 24 may be connected to the second blind wave plate 22 and the third blind wave plate 23 in a way that refers to the connection of the top gusset 24 to the first blind wave plate 21.

The fastener is disposed below the assembly rail 245 so that the fastener is accommodated inside the assembly rail 245, thereby avoiding exposure of the bolt hole and the perforation, and ensuring sealing performance and water resistance. At the same time, after the fastener is hidden, the aesthetics of the roof panel module is improved.

The left and right sides of the first blind wave plate 21, the second blind wave plate 22 and the third blind wave plate 23, and the front end of the first blind wave plate 21 and the rear end of the third blind wave plate 23 are provided with bolt holes for detachable connection with other container wallboard modules.

In other embodiments, the second blind wave plate 22 may also be divided into two blind wave plate sections or three blind wave plate sections disposed sequentially along the length direction of the roof panel module 2, and the specific number may be selected according to actual needs. Two adjacent blind wave plate sections can be detachably connected by connecting rails. The connecting rails are square tubular shaped and provided with through holes in a bottom wall thereof, and downward recessed trough portions 212 of the adjacent two blind wave plate sections are located below the bottom walls of the connecting rails, and can be detachably connected by fasteners.

That is, the roof panel module 2 may also be divided into detachably connected six parts, seven parts or another amount of parts.

The roof panel module 2 includes five parts, namely, the first blind wave plate 21, the second blind wave plate 22, the third blind wave plate 23 and two top gussets 24, which are fabricated and surface treated at the place of manufacture, and then assembled to form the roof panel module 2 after transport to the destination. The two top gussets 24 can be detachably connected to the first blind wave plate 21, the second blind wave plate 22 and the third blind wave plate 23 during assembly. The joints may be coated with sealant.

The strength of the top corner 243 of the roof panel module 2 may be increased by widening the top wall 2431 and the side wall 2432 of the top corner 243.

The connection method between the assembled roof panel module 2 and the side wall module 1 is as follows:

The roof panel module 2 is covered on the two side wall modules 1, and the first blind wave plate 21, the second blind wave plate 22 and the third blind wave plate 23 of the roof panel module 2 are overlapped above the top side rails 13 of the side wall modules 1 and connected by fasteners. The top corner 243 of the top gusset 24 is located at the notch 1154 of the side column 11, the connecting plate 242 is located inside the extension 1152 of the side column 11, and the connection between the connecting plate 242 and the extension 1152 achieved by fasteners.

When the connection is completed, sealant may be applied at the junction between the roof panel module 2 and the side wall modules 1.

Figure 14:
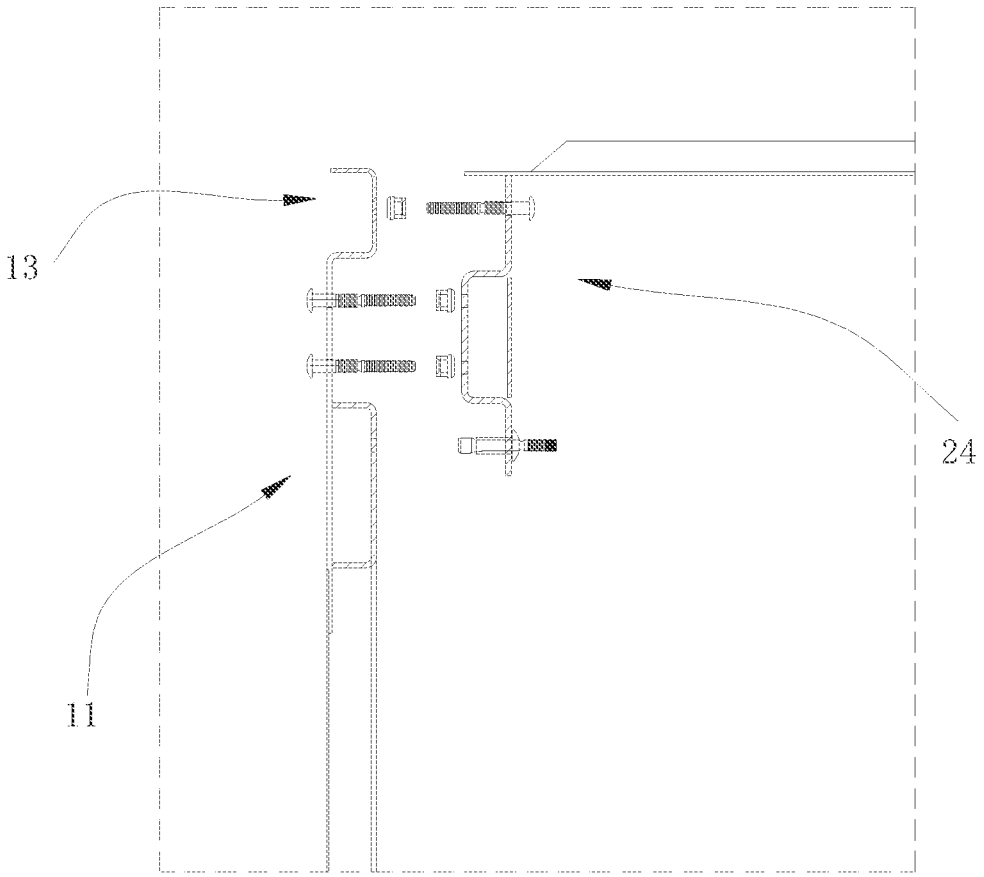
FIG. 14 is a structural schematic diagram of the roof panel module connected to the side wall module at the side column in the present disclosure.

Further, FIG. 14 shows a structural schematic diagram of the roof panel module 2 connected to the side wall module 1 at the side columns 11. Referring to FIG. 14, the connecting plate 242 of the top gusset 24 includes a protrusion extending downward from the top corner 243. The protrusion extends outward from the top corner 243, and a mounting hole is provided on the protrusion.

In this embodiment, the protrusion is composed of a top wall, a bottom wall and a side wall connecting the top wall and the bottom wall. The top wall and the bottom wall are disposed at parallel intervals, extend in the horizontal direction, and protrude outward from the top corner 243, and the side wall is located outside the top wall and the bottom wall.

The inner side of the connecting end 112 of the side column 11 is provided with a containing groove with an inward opening, an outer wall of the containing groove is provided with connecting holes.

The protrusion is located in the containing groove, and the fasteners are penetrated in the connecting hole and the mounting hole.

Figure 15:
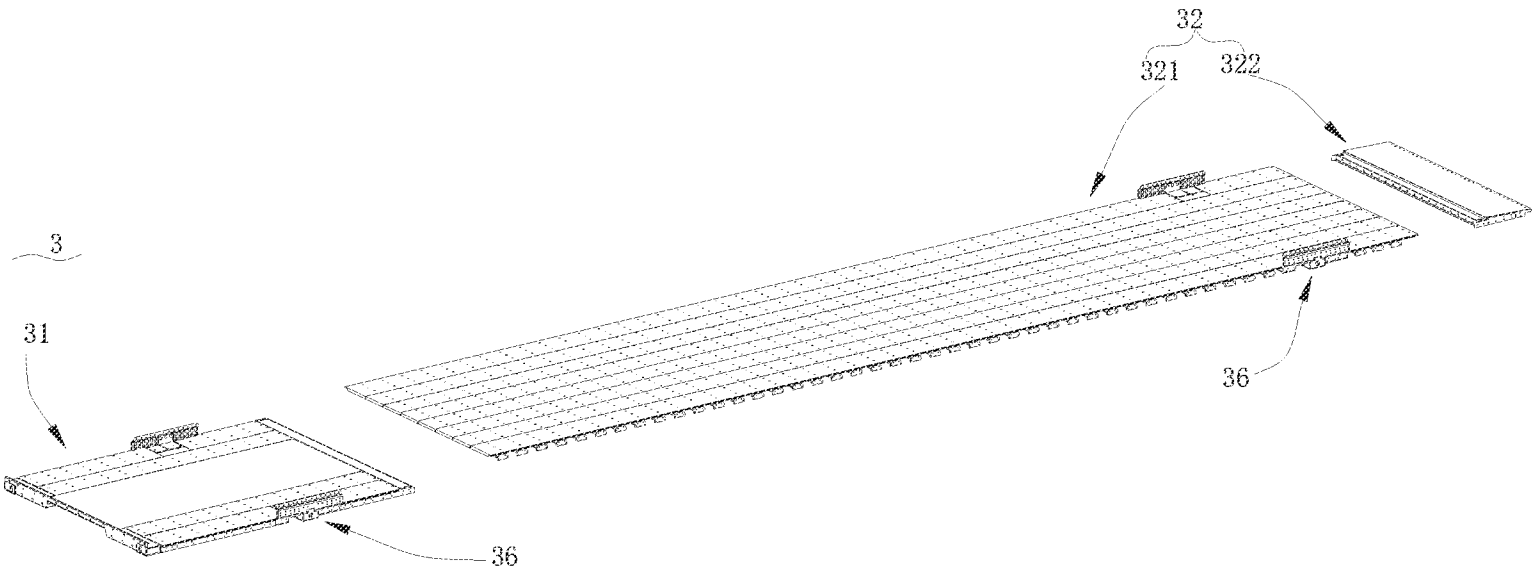
FIG. 15 is an exploded schematic diagram of a bottom plate module in an embodiment of the present disclosure.

FIG. 15 shows an exploded schematic diagram of a bottom plate module 3. With reference to FIGS. 2 and 15, the bottom plate module 3 includes a first base module 31 and a second base module 32 that are detachably connected. The first base module 31 and the second base module 32 are disposed sequentially in the length direction, and a bottom gusset 36 is provided on each of the first base module 31 and the second base module 32. The bottom gusset 36 includes a horizontal bottom plate and assembly plates which extend upward and are disposed at two ends of the bottom plate. The assembly plate is provided with through holes for detachable connection with other wallboard modules, and a bottom corner is disposed at a junction of the bottom plate and the assembly plate. The bottom corner is provided with a function hole, and a distance between the function holes of the two bottom gussets 36 may be 40 feet. The bottom plate module may be made to meet the requirements of standard containers by means of functional holes at a distance of 40 feet.

The distance between the functional holes refers to the distance along the length direction of the bottom plate module 3.

The first base module 31 is located at the front end of the second base module 32. Specifically, the first base module 31 includes a first base and a substrate laid on the first base. The first base is a square frame structure, and through holes are disposed on the front end walls and the two side walls around the first base.

Figure 16:
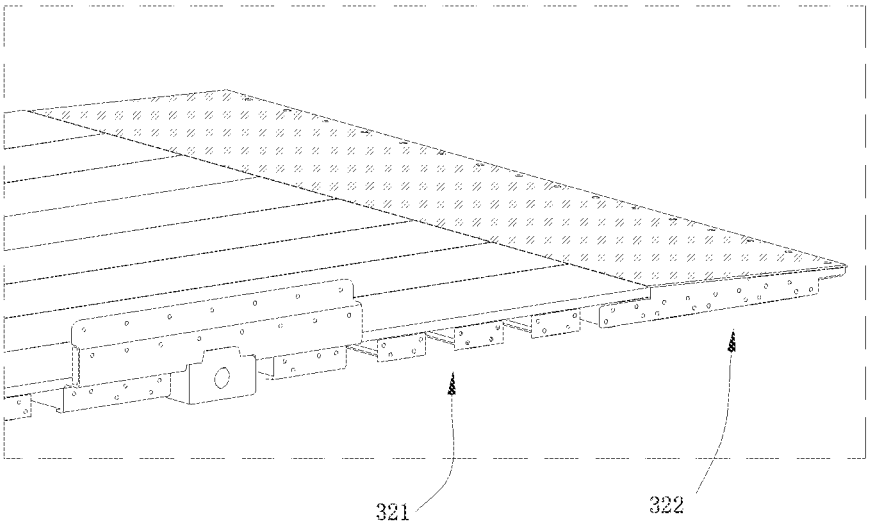
FIG. 16 is a partial structural schematic diagram of a second base module in the present disclosure.
Figure 17:
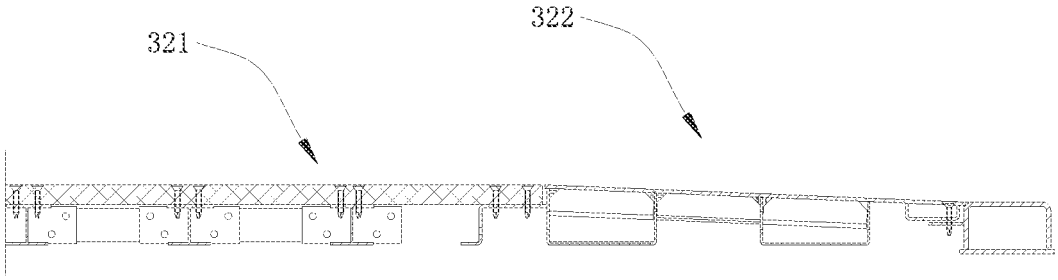
FIG. 17 is a partial front view of the second base module in the present disclosure.

FIG. 16 shows a partial structural schematic diagram of the second base module 32, and FIG. 17 shows a front view of the second base module 32. With reference to FIGS. 16 and 17, the second base module 32 includes a base body 321 and a rear-end gusset 322. The rear end of the base body 321 and the front end of the rear-end gusset 322 are detachably connected. In other embodiments, the second base module 32 may be a single unit.

That is, the entire floor module 3 may be two parts or three parts which are detachably connected.

The rear-end gusset 322 includes a frame-type stiffener frame and a floor provided on the stiffener frame. The stiffener frame and floor are made of steel. With the arrangement of the rear-end gusset 322, the strength of the rear end of the bottom plate module 3 is increased and the forklift impact resistance of the bottom plate module 3 is improved. In addition, the rear-end gusset 322 is detachably connected to the base body 321 so that the rear-end gusset 322 can be detached for maintenance and replacement, and the bottom plate module 3 is easy to maintain and replace.

In this embodiment, the upper surface of the rear-end gusset 322 is gradually inclined downward from front to back.

The base body 321 includes a plurality of bottom cross members disposed at parallel intervals and support plates laid on the bottom cross members. The bottom cross members extend in the width direction of the bottom plate module 3, and the support plates extend in the length direction of the bottom plate module 3. The front end of the support plate protrudes forward from the bottom cross member located at the front end, and the rear end of the support plate protrudes backward from the bottom cross member located at the rear end.

The front end of the rear-end gusset 322 has a step on which the base body 321 overlaps, and the upper surface of the base body 321 is flush with the upper surface of the floor. The step is composed of a lapping plate extending horizontally and a bearing plate extending vertically, and bolt holes are disposed on the lapping plate.

Specifically, the support plate is overlapped on the step, and the upper surface of the support plate is flush with the upper surface of the floor. Bolt holes are disposed on the support plate, and fasteners are penetrated through the bolt holes on the support plate and the bolt holes on the lapping plate to achieve detachable connection.

Further, a vertically extending butt plate is disposed below the lapping plate, and the butt plate is butted with the bottom cross member at the rear end of the second base module 32, and can be detachably connected through fasteners.

The rear end of the first base module 31 has a step, and the support plate of the second base module 32 protrudes forward and overlaps on the step so that the upper surface of the first base module 31 is flush with the upper surface of the second base module 32. The rear end of the first base module 31 is detachably connected to the front end of the second base module 32 in a way that refers to the detachable connection between the rear end of the second base module 32 and the front end of the rear-end gusset 322.

The bottom plate of the bottom gusset 36 and the two assembly plates form a U-shaped structure. In this embodiment, the floor and the assembly plate are integrally formed, and in other embodiments, the assembly plate is welded with the floor.

The function hole on the bottom wall of the bottom corner plays the role of bolting, and the function hole on the side wall of the bottom corner plays the role of bolting, lifting and observing.

Figure 18:
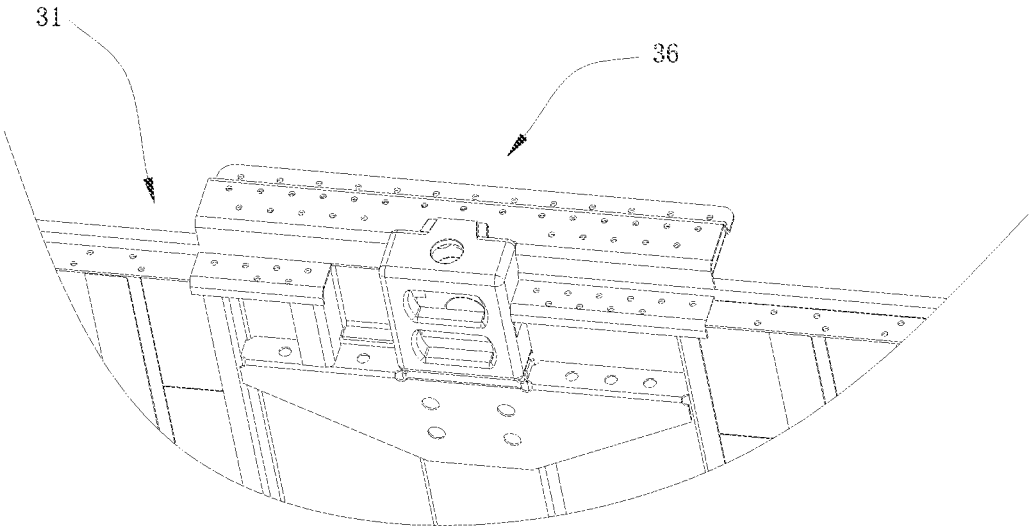
FIG. 18 is a partial structural schematic diagram of the first base module in the present disclosure.

FIG. 18 shows a partial structural schematic diagram of the first base module 31. Referring to FIG. 18, two functional holes are disposed at parallel intervals on the bottom wall of the bottom corner to meet different regulatory requirements.

In this embodiment, the bottom plate module 3 includes three parts, namely, the first base module 31 and the base body 321 and the rear-end gusset 322 of and the second base module 32. The above three parts are fabricated and surface treated at the place of manufacture, and then assembled to form the bottom plate module 3 after transport to the destination. The base body 321 can be detachably connected to the first base module 31 and the rear-end gusset 322 during assembly. The joints may be coated with sealant.

The bottom plate module 3 is connected to the side wall module 1 in the following manner.

The two side wall modules 1 are respectively positioned on opposite sides of the base module, and the extensions 1152 of the side wall modules 1 are attached to the inner side of the assembly plate of the base module and connected by fasteners. The bottom side rail 14 of the side wall module 1 is located at the sides of the first base module 31 and the second base module 32 of the base module, and is detachably connected by fasteners.

When the connection is completed, the sealant may be applied at the junction between the bottom plate module 3 and the side wall module 1.

Figure 19:
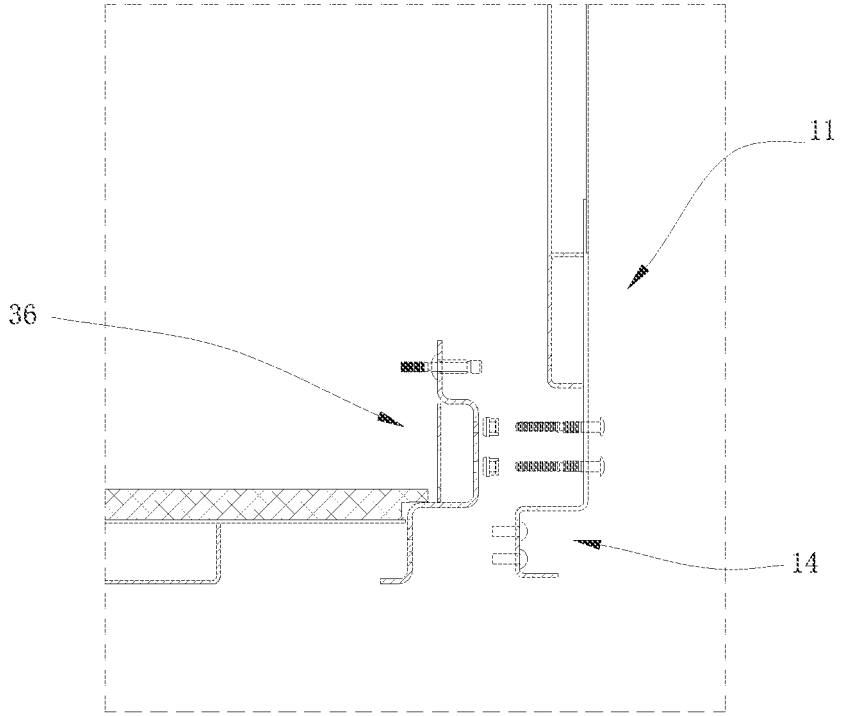
FIG. 19 is a structural schematic diagram of the roof panel module connected to the side wall module at the side column in the present disclosure.

Further, FIG. 19 shows a structural schematic diagram of the bottom plate module 3 connected to the side wall module 1 at the side column 11 in the present disclosure. Referring to FIG. 19, an assembly plate of the bottom gusset 36 includes a projection protruding upward from the bottom corner, the projection protrudes outward from the bottom corner and is provided with an assembly hole.

In the embodiment, the projection is composed of a top wall, a bottom wall and a side wall connecting the top wall and the bottom wall which are disposed at parallel intervals. The top wall and the bottom wall extend in the horizontal direction and project outward from the bottom corner, and the side wall is located outside the top wall and the bottom wall.

The inner side of the connecting end 112 of the side column 11 is provided with a containing groove with an inward opening, and an outer wall of the containing groove is provided with a connecting hole.

The projection is located in the containing groove, and the fastener is penetrated in the connecting hole and the assembly hole.

Figure 20:
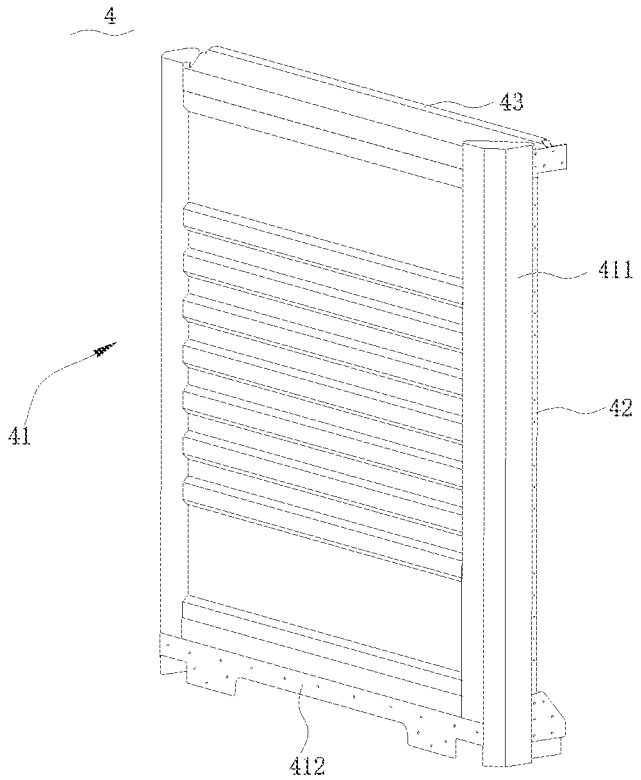
FIG. 20 is a structural schematic diagram of a front wall module in an embodiment of the present disclosure.
Figure 21:
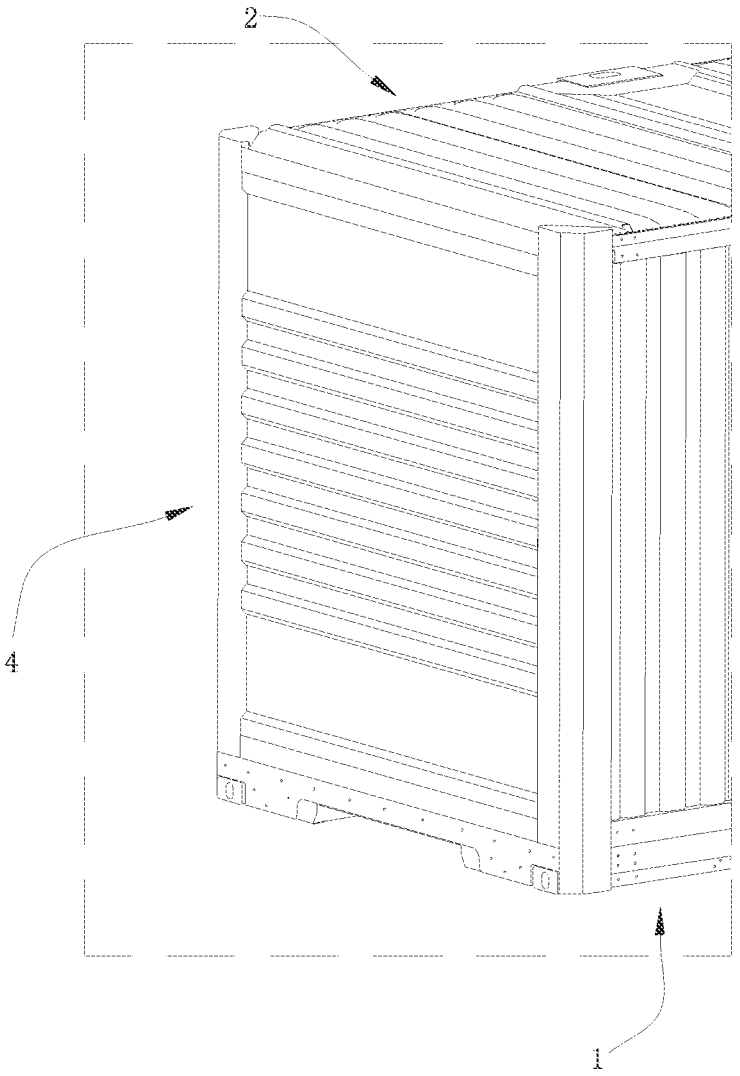
FIG. 21 is a structural schematic diagram of the front wall module, part of the side wall module and part of the roof panel module in the present disclosure.

FIG. 20 shows a structural schematic diagram of the front wall module 4, and FIG. 21 shows a structural schematic diagram of the front wall module 4, a part of the side wall module 1 and a part of the roof panel module 2 in this embodiment. With reference to FIG. 2, FIG. 20 and FIG. 21, the front wall module 4 includes an end frame 41, a mounting rail 43 on the top of the end frame 41, and mounting plates 42 on both sides of the end frame 41.

The end frame 41 includes two corner posts 411 disposed at parallel intervals and a top end sill connected at a position between the tops of the corner posts 411 and a bottom end sill 412 connected between the bottoms of the corner posts 411. That is, the front wall module 4 includes two corner posts 411 disposed at parallel intervals.

Figure 22:
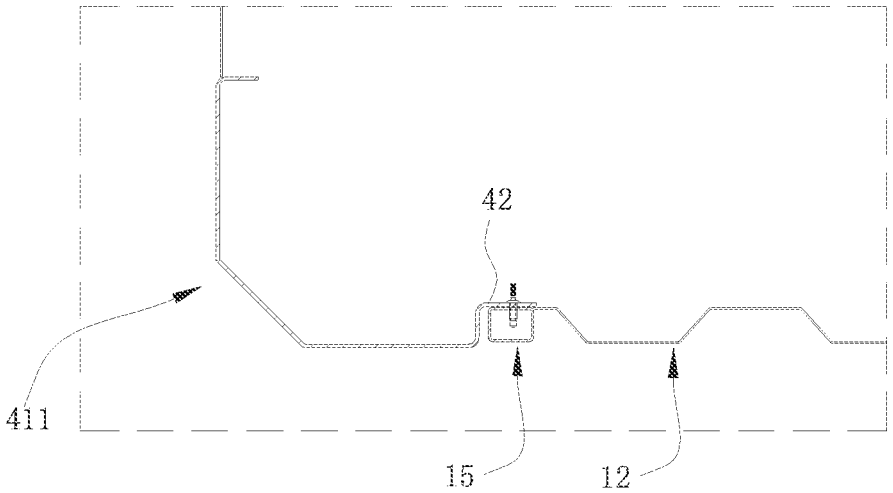
FIG. 22 is a schematic diagram of a connection between the front wall module and the part of the side wall module in the present disclosure.

Further, an inclined connecting surface is disposed between a front end surface and an outer side surface of each of the corner posts 411. An included angle between the inclined connecting surface and the front end surface may be an obtuse angle, and an included angle between the inclined connecting surface and the outer side surface may be an obtuse angle. In this embodiment, as shown in FIG. 22, the angle between the inclined connecting surface and the front end surface is 135°, and the angle between the inclined connecting surface and the outer side surface is 135°.

The use of the corner post 411 with the inclined connecting surface improves aerodynamic performance, reduces the corner radius, and lowers the impact damage probability.

Figure 23:
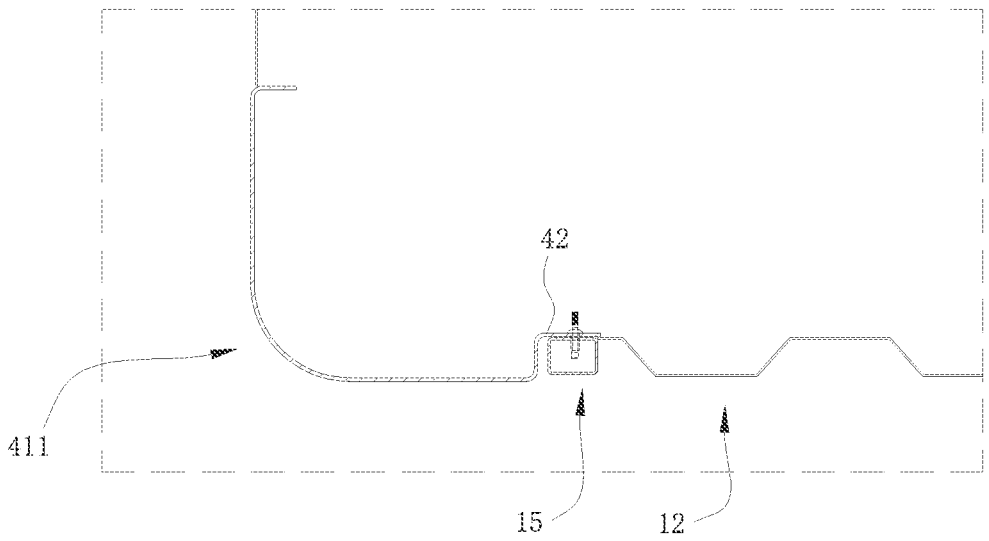
FIG. 23 is a schematic diagram of the front wall module connected to the part of the side wall module in another embodiment in the present disclosure.

In other embodiments, as shown in FIG. 23, a circular arc connecting surface is formed between the front end surface and the outer side surface of each of the corner posts 411, with the convex surface of the circular connection surface facing outward.

The mounting plate 42 protrudes toward the side wall module 1, and the two mounting plate 42 corresponds to each of the two side wall modules 1, that is, the front ends of the two side wall modules 1 correspond one-to-one with the mounting plate 42 of the front wall module 4. The wallboard body of each of the side wall modules 1 is attached to the outer side of the corresponding mounting plate 42 and can be detachably connected to the mounting plate 42.

Specifically, a plurality of bolt holes are provided in the mounting plate 42, and the assembly column 15 of the side wall module 1 has a square tubular shape, and the mounting holes are provided in the inner wall of the assembly column 15. The assembly column 15 is located outside the mounting plate 42, and the mounting holes on the assembly column 15 and the bolt holes on the mounting plate 42 are detachably connected by fasteners.

The fasteners are inserted from the inside through the bolt holes in the mounting plate 42 and the assembly holes in the inner wall of the assembly column 15 to achieve the detachable connection between the front wall module 4 and the side wall module 1. By the above connection mode, the fasteners are received in the container 800, thereby avoiding opening a hole on the outer side of the box body, thereby having better waterproof performance. At the same time, the fasteners are hidden inside the container to make the outside of the container 800 more beautiful.

In this embodiment, the mounting plate 42 is inwardly retracted so that the outside of the corner post 411 protrudes outward from the mounting plate 42, so that the outside of the assembly column 15 is flush with the outside of the corner post 411 when the assembly column 15 is attached to the outside of the mounting plate 42.

The mounting rail 43 protrudes towards the roof panel module 2, and the mounting rail 43 has a square tubular shape with a perforation provided in the bottom wall thereof. A bolt hole is provided at the end of the first blind wave plate 21 facing the mounting rail 43.

Figure 24:
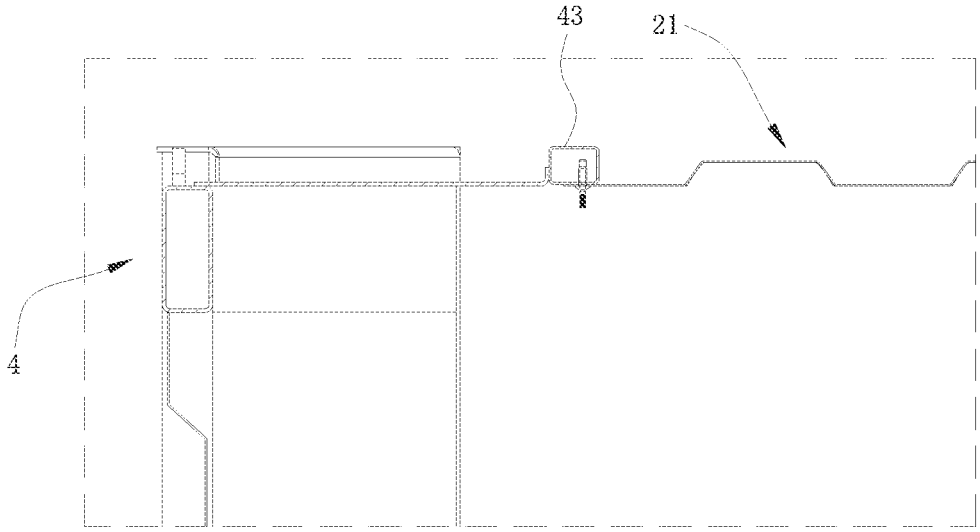
FIG. 24 is a schematic diagram of a connection between the front wall module and the part of the roof panel module in the present disclosure.

FIG. 24 shows a schematic diagram of a connection between the front wall module 4 and the part of the roof panel module 2. Referring to FIG. 24, the mounting rail 43 of the front wall module 4 is overlapped over the first blind wave plate 21, and a detachable connection between the front wall module 4 and the roof panel module 2 is achieved by a fastener.

The mounting rail 43 is overlapped above the trough portion 212 of the first blind wave plate 21.

In this embodiment, the front wall module 4 and the roof panel module 2 are detachably connected by the fastener that passes through the bolt hole in the first blind wave plate 21 and the hole in the bottom wall of the mounting rail 43 from below. By the above connection mode, the fastener is received in the container 800, thereby avoiding opening a hole on the outer side of the box body, thereby having better waterproof performance. Furthermore, the fasteners are hidden inside the container 800 to make the outside of the container 800 more beautiful.

The bottom end sill 412 of the end frame 41 is provided with bolt holes. The front end part of the first base module 31 of the bottom plate module 3 is provided with through holes, and the bottom end sill 412 is attached to the front end part of the first base module 31, and can be detachably connected to the front end part of the first base module 31 through fasteners.

Further, the front wall module 4 also includes stiffeners disposed at the top and bottom of the corner post 411. The stiffeners protrude backward, that is, to the side wall module 1. Threaded holes are provided on the stiffeners to increase the connection strength between the front wall module 4 and the side wall module 1.

The front wall module 4 in this embodiment is a single unit, which is fabricated and surface treated at the place of manufacture, and then assembled with other wallboard modules after transport to the destination. The front wall module 4 is detachably connected to the assembly column 15 of the side wall module 1 through the mounting plate 42, to the first blind wave plate 21 of the roof panel module 2 through the mounting rail 43, and to the bottom plate module 3 through the bottom end sill 412.

Figure 25:
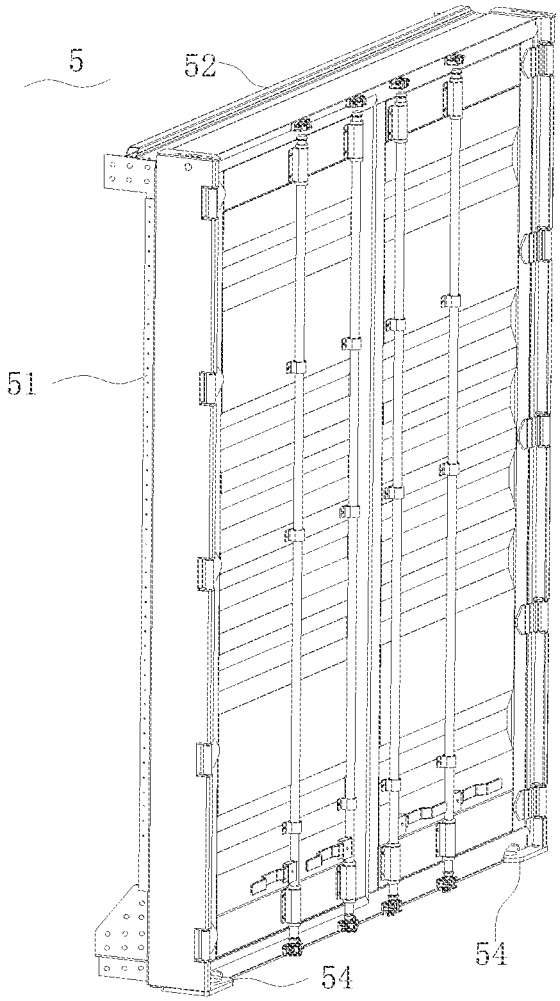
FIG. 25 is a structural schematic diagram of a back wall module in the present disclosure.
Figure 26:
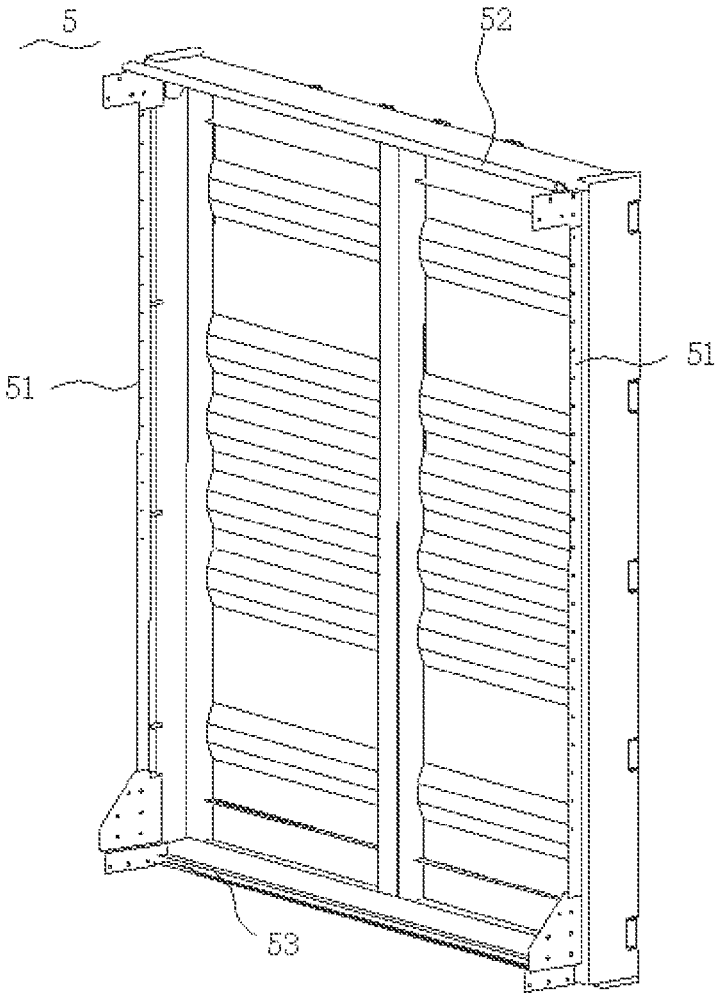
FIG. 26 is a structural schematic diagram of the rear wall module in another direction in the present disclosure.

FIG. 25 shows a structural schematic diagram of the rear wall module 5 in this embodiment, and FIG. 26 shows a structural schematic diagram of the rear wall module 5 in another direction. With reference to FIG. 25 and FIG. 26, the rear wall module 5 includes an end frame, a mounting rail 52 located at the top of the end frame, and mounting plates 51 located at both sides of the end frame.

The bottom-end transverse member 53 of the end frame has a square tubular shape having a space inside, and a groove with an opening facing the bottom is provided on the bottom-end transverse member 53. Specifically, openings are formed in the rear side wall and the bottom wall of the bottom-end transverse member 53 to form grooves. A corner plate 54 is disposed at the groove, the corner plate 54 extends horizontally, and the corner plate 54 and the bottom-end transverse member 53 are enclosed together to form a functional hole, which is located at the rear side of the rear wall module 5 and used for bolting, observing and lifting.

The corner plate 54 is also provided with a function hole located at the bottom of the rear wall module 5 for bolting.

That is, the corner plate 54 and the bottom-end transverse member 53 together constitute the bottom corner of the rear wall module 5.

The mounting plate 51 protrudes toward the side wall module 1, and the two mounting plates 51 correspond to the two side wall modules 1 one-to-one, that is, the rear ends of the two side wall modules 1 correspond one-to-one with the mounting plates 51 of the rear wall module 5. The wallboard body of each of the side wall modules 1 is attached to the outer side of the corresponding mounting plate 51 and can be detachably connected to the mounting plate.

Specifically, a plurality of bolt holes are provided in the mounting plate 51, and the assembly column 15 of the side wall module 1 has a square tubular shape, and the mounting hole is provided in the inner wall thereof. The assembly column 15 is located outside the mounting plate 51, and the assembly hole on the assembly column 15 and the bolt hole on the mounting plate 51 are detachably connected by a fastener.

In this embodiment, the mounting plate 51 is inwardly retracted so that the outside of the end frame protrudes outward from the mounting plate 51, so that the outside of the assembly column 15 is flush with the outside of the end frame when the assembly column 15 is attached to the outside of the mounting plate 51.

Figure 27:
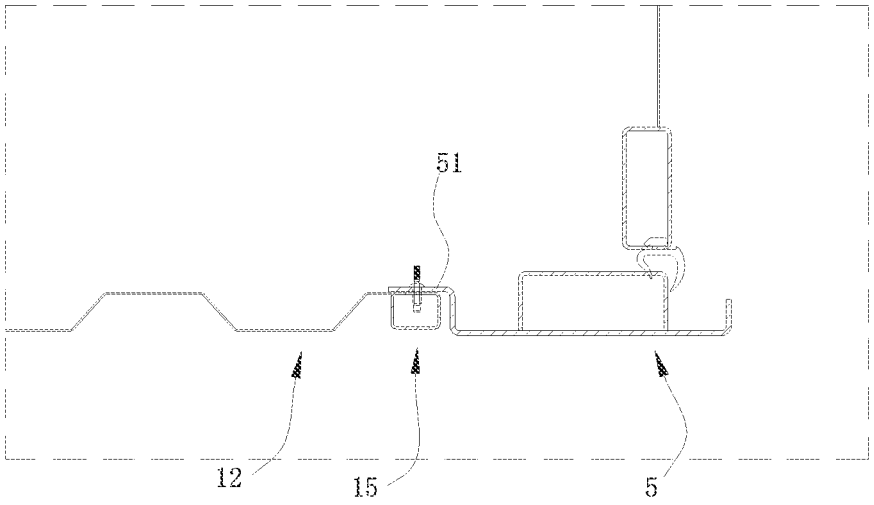
FIG. 27 is a schematic diagram of the rear wall module connected to the side wall module in the present disclosure.

FIG. 27 shows a schematic diagram of the rear wall module 5 connected to the side wall module 1. Referring to FIG. 27, a fastener is inserted from the inside through a bolt hole in the mounting plate 51 and the assembly hole in the inner wall of the assembly column 15 to achieve the detachable connection between the rear wall module 5 and the side wall module 1. By the above connection mode, the fastener is received in the container 800, thereby avoiding opening a hole on the outer side of the box body, thereby having better waterproof performance. In addition, the fasteners are hidden inside the container 800 to make the outside of the container 800 more beautiful.

The mounting rail 52 protrudes towards the roof panel module 2, and the mounting rail 52 has a square tubular shape with a perforation provided in the bottom wall thereof. A bolt hole is provided at the end of the third blind wave plate 23 facing the mounting rail 52.

Figure 28:
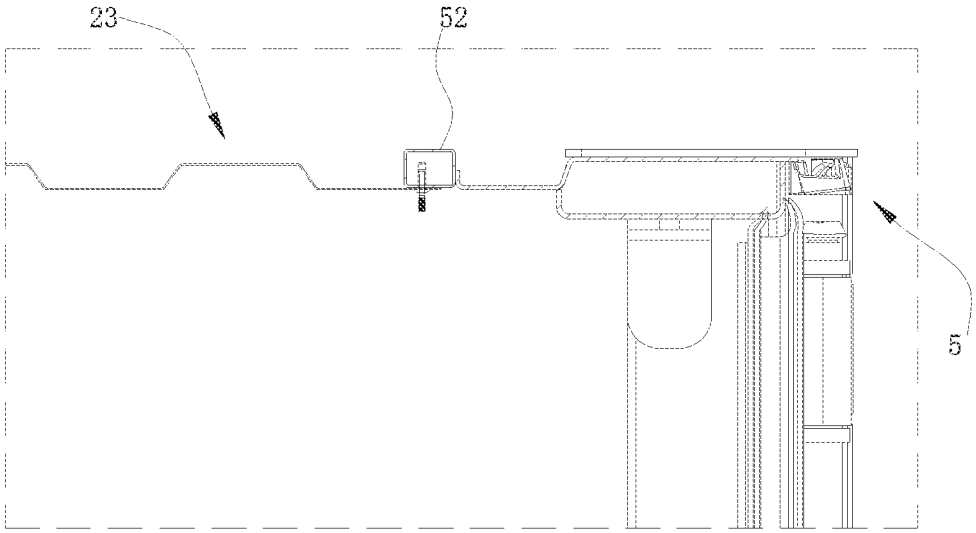
FIG. 28 is a schematic diagram of the rear wall module connected to the roof panel module in the present disclosure.

FIG. 28 shows a schematic diagram of the rear wall module 5 connected to the roof panel module 2. Referring to FIG. 28, the mounting rail 52 of the rear wall module 5 is overlapped over the third blind wave plate 23, and a detachable connection between the rear wall module 5 and the roof panel module 2 is achieved by a fastener.

The mounting rail 52 is overlapped above the trough portion 212 of the third blind wave plate 23.

In this embodiment, the fastener is threaded through, from below, the bolt hole in the third blind wave plate 23 and the hole in the bottom wall of the mounting rail 52 to achieve the detachable connection between the rear wall module 5 and the roof panel module 2. By the above connection mode, the fastener is received in the container 800, thereby avoiding opening a hole on the outer side of the box body, thereby having better waterproof performance. In addition, the fastener is hidden inside the container 800 to make the outside of the container 800 more beautiful.

The rear wall module 5 also includes a connecting rail disposed at the bottom of the end frame. The connecting rail protrudes towards the bottom plate module 3, the connecting rail has an accommodating cavity with an opening facing the bottom plate module 3, the rear end of the second base module 32 of the bottom plate module 3 is inserted into the accommodating cavity, so as to achieve the detachable connection between the second base module 32 and the connecting rail by a fastener.

Specifically, in this embodiment, the rear end of the rear-end gusset 322 is inserted into the accommodating cavity. The rear end of the floor is provided with a bolt hole. The floor is disposed in the accommodating cavity, a top wall of the accommodating cavity is provided with a bolt hole and is detachably connected to the floor by a fastener.

Further, the rear wall module 5 also includes stiffeners disposed at the top and bottom of the corner end frame. The stiffeners protrude forward, that is, to the side wall module 1. A threaded hole is provided on each the stiffener to increase the connection strength between the rear wall module 5 and the side wall module 1.

The rear wall module 5 in this embodiment is a single unit, which is fabricated and surface treated at the place of manufacture, and then assembled with other wallboard modules after transport to the destination. The rear wall module 5 is detachably connected to the assembly column 15 of the side wall module 1 through the mounting plate 51, to the third blind wave plate 23 of the roof panel module 2 through the mounting rail 52, and to the bottom plate module 3 through the bottom-end transverse member 53.

The assembled container 800 is obtained through the detachable connection of the two side wall modules 1, the roof panel module 2, the bottom plate module 3, the front wall module 4 and the rear wall module 5, which enables the production as well as packaging and transportation in pieces, and off-site final assembly and delivery.

After the container 800 is assembled, both ends of each side column 11 are connected to a top gusset 24 and a bottom gusset 36, two ends of the top gusset 24 are respectively connected to the side columns 11 of the two side wall modules 1, and two bottom corners of each bottom gusset 36 are respectively connected to the side columns 11 of the two side wall modules 1. The corresponding side columns 11 of the two side wall modules 1, the top gusset 24 and the bottom gusset 36 are enclosed together to form a column frame. That is, one top gusset 24, one bottom gusset 36 and two side upright member 11 are collectively enclosed to form a column frame. The container 800 includes two column frames. A distance between the two column frames is 40 feet.

The container 800 also includes bottom corners located at four corners of the bottom. Two bottom corners at a front end are fixed on a front end of the bottom plate module 3, and two bottom corners at a rear end are fixed on a bottom of the rear wall module 5.

Specifically, a bottom corner at the front end is fixed to the front end of the bottom plate module 3. The bottom corner at the front end has a function hole at the front end and a function hole at the bottom. The bottom corner of the front end can be used from the related art.

The bottom corner at the rear end has a function hole at the rear end and a function hole at the bottom. The bottom corner at the rear end is composed of a corner plate and an end frame.

The bottom corners at the front end and the rear end respectively enable the container 800 to meet the requirements of a 53-foot container, and the top corners 243 and the bottom corners of the side column 11 enable the container 800 to meet the requirements of a 40-foot container.

The container 800 may also include a plurality of cargo-fixing mechanisms. The cargo-fixing mechanism can be a fixing steel bar or a grip hook.

The upper and lower ends of the side wall module 1 are provided with the cargo-fixing mechanisms, and a plurality of cargo-fixing mechanisms are disposed at intervals from front to back. Specifically, both the top side rail 13 and the bottom side rail 14 have grooves in which the cargo-fixing mechanism is fixed. The packing mechanism is fixed in the container 800.

According to this embodiment, due to the six modules of the container box being detachably connected, the container 800 can be manufactured, packaged and transported in pieces, and can be assembled and delivered in different places, so that the cost is reduced. The strength of the top corner 243 may be increased by widening the top wall 2431 and the side wall 2432 of the top corner 243, the strength of the side column 11 may be increased by widening both ends of the side column 11, the strength of the column frame at 40 feet may be increased, and the impact resistance performance may be effectively improved.

Also, after the container 800 is divided into a plurality of detachably connected structures, dimensions of the wallboard and parts of the container can be effectively reduced, so that some parts of the container can be surface treated by methods such as hot-dip galvanization, electrophoresis and powder spraying, and the requirements for tooling and equipment may be reduced.

As the container 800 has multiple detachably connected structures, it may be easy to maintain and repair.

From the technical solution, it can be seen that the advantages and positive effects of the present disclosure are as follows:

One of the container wallboard modules in the present disclosure, i.e., the side wall module, includes two side columns with a distance of 40 feet therebetween, and the upper and lower ends of each column are widened to increase the strength of the side columns.

Another container wallboard module of the present disclosure, i.e., the roof panel module, includes two top gussets with a distance of 40 feet therebetween, each of the top gussets includes two top corners, and the strength of each of the top corners is increased by widening the top and side walls.

According to the present disclosure, due to the six modules of the container box being detachably connected, the container can be manufactured, packaged and transported in pieces, and can be assembled and delivered in different places, so that the cost is reduced.

The side columns of the corresponding two side wall modules, the top gussets of the roof panel module and the bottom gussets of the bottom plate module are enclosed to form a column frame, which the strength of the side column is increased by widening the upper and lower ends of each side column respectively, thereby increasing the strength of the column frame and effectively improving the impact resistance performance.

While the present disclosure has been described with reference to several exemplary embodiments, it should be understood that the terms used herein are illustrative and exemplary and are not limiting. Since the present disclosure can be embodied in various forms without departing from the spirit or essence of the present disclosure, it should therefore be understood that the foregoing embodiments are not limited to any of the foregoing details, but are to be interpreted broadly within the spirit and scope defined by the appended claims, so that all variations and modifications falling within the scope of the claims or their equivalents are to be covered by the appended claims.

What is claimed is:

1. A container comprising a first side wall module, a second side wall module, a roof panel module, a bottom plate module, a front wall module, and a rear wall module, which are detachably connected;

wherein the first side wall module and the second side wall module each comprise a respective wallboard body provided with assembly holes for detachable connection with other wallboard modules; and a first side column and a second side column disposed on each respective wallboard body, the first side column and the second side column deviating from two ends of the respective wallboard body in a length direction, wherein each of the first side column and the second side column comprise a respective column body and two connecting ends respectively formed at upper and lower ends of the column body, wherein the connecting ends protrude from the column body in a front-back direction, and wherein the connecting ends are provided with connecting holes for detachable connection with the other wallboard modules;

wherein the roof panel module comprises a first blind wave plate, a second blind wave plate, and a third blind wave plate disposed sequentially in a length direction, and the roof panel module comprises a first top gusset and a second top gusset;

wherein the first top gusset is detachably connected at a position between the first blind wave plate and the second blind wave plate, another one of the second top gusset is detachably connected at a position between the second blind wave plate and the third blind wave plate, wherein each of the first top gusset and the second top gusset comprise a respective horizontal roof panel and a respective connecting plate extending downward and disposed at respective ends of the roof panel, and each of the connecting plates is provided with a mounting hole for detachable connection with other wallboard modules, and wherein a top corner is provided at a junction of the roof panel module and each connecting plate, and the top corner is provided with a functional hole;

wherein the bottom plate module comprises a first base module and a second base module being detachably connected to the first base module, wherein the first base module and the second base module are disposed sequentially in a longitudinal direction, and the first base module comprises a first bottom gusset and the second base module comprises a second bottom gusset; and wherein the respective connecting ends of the first side column in the first side wall module are respectively connected to the first top gusset and the two bottom corners of the first bottom gusset and the respective connecting ends of the second side column in the first side wall module are respectively connected to the second top gusset and the two bottom corners of the second bottom gusset, the ends of of the first side column in the second side wall module are respectively connected to the first top gusset and the two bottom corners of the first bottom gusset and the ends of the second side column in the second side wall module are respectively connected to the second top gusset and the two bottom corners of the second bottom gusset; such that the first and second side columns of each of the first and second side wall modules, the first and second top gussets and the first and second bottom gussets are enclosed together to form a column frame.

2. The container according to claim 1, wherein the first blind wave plate, the second blind wave plate and the third blind wave plate cover the top of the two first side wall module and the second side wall module and are detachably connected by fasteners; and the respective connecting plate of the first top gusset located inside one of the connecting ends of the first side column, and the respective connecting plate of the second top gusset and the connecting end of the second side column located inside one of the connecting ends of the second side column, are detachably connected by a fastener penetrating through a connecting hole and a mounting hole.

3. The container according to claim 1, wherein each of the first bottom gusset and the second bottom gusset further comprises a respective assembly plate located inside the respective connecting end of one of the respective side columns, and each respective assembly plate of each of the first bottom gusset and the second bottom gusset and the respective connecting end of one of the side columns are detachably connected by a fastener penetrating through a connecting hole and a mounting hole.

4. The container according to claim 1, wherein each wallboard body of each of the first side wall module and the second side wall module is provided with an assembly column at an outer side of the respectively attached mounting plate, each assembly column is in a square tubular shape, an assembly hole is opened in an inner side wall of the assembly column, and the assembly hole is detachably connected to a bolt hole on each respective mounting plate by a fastener.

5. The container according to claim 1, wherein the rear wall module comprises an end frame and a mounting rail located at a top of the end frame, wherein the mounting rail protrudes to the roof panel module, the mounting rail is in a shape of a square tube, a perforation is opened on a bottom wall of the mounting rail, and the third blind wave plate is provided with bolt holes; and wherein the mounting rail of the rear wall module is overlapped above the third blind wave plate, and the rear wall module is detachably connected to the roof panel module by a fastener.

6. The container according to claim 1, wherein the front wall module comprises an end frame, of which a bottom end sill is opened with a bolt hole, wherein an end portion of the front end of the first base module is provided with a through hole, and the bottom end sill is attached to the front end of the first base module and is detachably connected to the front end of the first base module by a fastener.

7. The container according to claim 1, wherein the rear wall module comprises an end frame and a connecting rail disposed at a bottom of the end frame, wherein the connecting rail protrudes to the bottom plate module and is provided with an accommodating cavity with an opening facing the bottom plate module, wherein a rear end of the second base module of the bottom plate module is inserted into the accommodating cavity and is detachably connected to the connecting rail by a fastener.

8. The container according to claim 1, wherein each connecting plate of each of the first top gusset and the second top gusset comprises a protrusion protruding downward and outward from the respective top corner, wherein the protrusion is provided with a mounting hole; and wherein each connecting end of each of the first side column and of the second side column is provided with a containing groove with an inward opening at an inner side wall, wherein each containing groove is provided with a connecting hole at an outer side wall, and wherein each protrusion is located in the respective containing groove, and a respective fastener penetrates into the corresponding connecting hole and the corresponding mounting hole.

9. The container according to claim 1, wherein each bottom gusset further comprises an assembly plate with a projection protruding upward and outward from the bottom corner, wherein the projection protruding is provided with an assembly hole; and wherein each of the connecting ends of each of the first side column and of the second side column is provided with a containing groove with an inward opening at an inner side wall, the containing groove is provided with the corresponding connecting hole at an outer side wall, the projection is located in the containing groove, and a respective fastener penetrates into the corresponding connecting hole and the corresponding assembly hole.

10. The container according to claim 1, wherein the container further comprises;

wherein two bottom corners at a front end of the container fixed on a front end of the bottom plate module, and two bottom corners at a rear end of the container fixed on a bottom end of the rear wall module.

11. The container according to claim 1, wherein the front wall module comprises two corner posts disposed in parallel at intervals, wherein an inclined connecting surface is disposed between a front end surface and an outer side surface of each of the corner posts, an included angle between the inclined connecting surface and the front end surface is an obtuse angle, and an included angle between the inclined connecting surface and the outer side surface is an obtuse angle.

12. The container according to claim 1, wherein the front wall module comprises two corner posts disposed in parallel at intervals, wherein a circular arc connecting surface is disposed between a front end surface and an outer side surface of each of the corner posts, and the circular arc connecting surface has a convex surface facing outward.

13. The container according to claim 1, wherein the front wall module comprises an end frame and a mounting plate, wherein the mounting plate protrudes to each of the first side wall module and second side wall module, wherein the front end of each of the first side wall module and the second side wall module corresponds to the mounting plate of the front wall module, and a wallboard body of each of the first side wall module and the second side wall module is attached and detachably connected to an outer side of the corresponding mounting plate.

14. The container according to claim 1, wherein the rear wall module comprises an end frame and a mounting plate, wherein the mounting plate protrudes to each of the first side wall module and the second side wall module, wherein a front end of each of the first side wall module and the second side wall module corresponds to the mounting plate of the rear wall module, and the wallboard body of each of the first side wall module and the second side wall module is attached and detachably connected to the outer side of the corresponding mounting plate.

15. The container according to claim 1, wherein the front wall module comprises an end frame and a mounting rail located at a top of the end frame, wherein the mounting rail protrudes to the roof panel module, the mounting rail is in a shape of a square tube, a perforation is opened on a bottom wall of the mounting rail, and the first blind wave plate is provided with bolt holes; and wherein the mounting rail of the front wall module is overlapped above the first blind wave plate, and the front wall module is detachably connected to the roof panel module by a fastener.

* * * * *